US011394138B2

(12) United States Patent
Shimizu et al.

(10) Patent No.: US 11,394,138 B2
(45) Date of Patent: Jul. 19, 2022

(54) TERMINAL BLOCK AND WIRE ROUTING UNIT

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroshi Shimizu, Mie (JP); Yusuke Isaji, Mie (JP); Hitoshi Takeda, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES. LTD., Oaaka (JP)

( * ) Notice: Subject to any disclaimer, the term of this patent is extended or adjusted under 35 U.S.C. 154(b) by 0 days.

(21) Appl. No.: 17/295,237

(22) PCT Filed: Nov. 14, 2019

(86) PCT No.: PCT/JP2019/044678
§ 371 (c)(1),
(2) Date: May 19, 2021

(87) PCT Pub. No.: WO2020/105537
PCT Pub. Date: May 28, 2020

(65) Prior Publication Data

US 2022/0013935 A1 Jan. 13, 2022

(30) Foreign Application Priority Data

Nov. 22, 2018 (JP) ..... JP2018-219477
Apr. 19, 2019 (JP) ..... JP2019-080017

(51) Int. Cl.
*H01R 9/24* (2006.01)
*H01R 13/58* (2006.01)
(Continued)

(52) U.S. Cl.
CPC ..... *H01R 9/2416* (2013.01); *H01R 9/18* (2013.01); *H01R 11/11* (2013.01); *H01R 13/58* (2013.01)

(58) Field of Classification Search
CPC ..... H01R 9/2416; H01R 9/18; H01R 11/11; H01R 13/58; H01R 13/5816;
(Continued)

(56) References Cited

U.S. PATENT DOCUMENTS 5,151,050 A * 9/1992 Scholz ..... H01R 13/58 439/456
5,380,220 A 1/1995 Okabe
8,647,160 B2 * 2/2014 Umemoto ..... H02S 40/34 439/845

FOREIGN PATENT DOCUMENTS

JP 56-020246 2/1981
JP 60-158571 8/1985
(Continued)

OTHER PUBLICATIONS

Official Communication issued in International Bureau of WIPO Patent Application No. PCT/JP2019/044678, dated Dec. 17, 2019, along with an English translation thereof.

*Primary Examiner* — Vanessa Girardi
(74) *Attorney, Agent, or Firm* — Greenblum & Bernstein, P.L.C.

(57) ABSTRACT

Provided is a terminal block that electrically connects a terminal connection portion provided at a terminal end of a covered wire and a device-side connection portion provided in a device to each other, the terminal block including: a contact placement portion on which the terminal connection
(Continued)

portion and the device-side connection portion are disposed in contact with each other; a wire installation portion that is provided continuously with the contact placement portion and on which the covered wire is disposed; and a stress relaxation portion that is disposed between the wire installation portion and the covered wire so as to be elastically displaceable, and that bends and holds the covered wire in a state in which a clearance is provided between the covered wire and the wire installation portion.

11 Claims, 19 Drawing Sheets

(51) Int. Cl.
*H01R 9/18* (2006.01)
*H01R 11/11* (2006.01)

(58) Field of Classification Search
CPC .. B60R 16/0215; B60R 16/0238; H02G 3/02; H02G 3/16; H02G 3/22
See application file for complete search history.

(56) References Cited

FOREIGN PATENT DOCUMENTS

| | | |
|---|---|---|
| JP | 60-158572 | 8/1985 |
| JP | 61-093565 | 5/1986 |
| JP | 04-015161 | 2/1992 |
| JP | 06-163090 | 6/1994 |
| JP | 2003-031300 | 1/2003 |
| JP | 2017-004874 | 1/2017 |

* cited by examiner

TERMINAL BLOCK AND WIRE ROUTING UNIT

TECHNICAL FIELD

The present disclosure relates to a terminal block and a wire routing unit.

BACKGROUND ART

The terminal block described in JP 2017-004874A (Patent Document 1) is known as an example of a terminal block that connects a connection terminal connected to a terminal end of a wire and a circuit terminal provided in a device to each other. The terminal block electrically connects the connection terminal and the circuit terminal to each other by fastening the connection terminal and the circuit terminal using a terminal bolt and a nut.

CITATION LIST

Patent Documents

Patent Document 1: JP 2017-004874A

SUMMARY OF INVENTION

Technical Problem

Meanwhile, when the wire connected to the connection terminal is used, for example, for large current and high voltage applications, the wire thermally expands or contracts due to the heat generated by the wire itself, the heat conducted from the connected terminal, and the like. When the wire thermally expands or contracts, the connection terminal connected to the wire is pushed or pulled in the axial direction of the wire, and stress is concentrated on the contact portion between the connection terminal and the circuit terminal, resulting in a failure in the contact portion.

Therefore, it is an object of the present disclosure to provide a terminal block and a wire routing unit each having a novel structure that can inhibit the occurrence of failures in a contact portion between a connection portion provided at a terminal end of a wire and a counterpart connection portion.

Solution to Problem

A terminal block according to the present disclosure is a terminal block that electrically connects a connection portion provided at a terminal end of a wire and a counterpart connection portion to each other, the terminal block including: a contact placement portion on which the connection portion and the counterpart connection portion are disposed in contact with each other; a wire installation portion that is provided continuously with the contact placement portion and on which the wire is disposed; and a stress relaxation portion that is disposed between the wire installation portion and the wire so as to be elastically displaceable, and that bends and holds the wire in a state in which a clearance is provided between the wire and the wire installation portion.

Advantageous Effects of Invention

According to the present disclosure, it is possible to inhibit the occurrence of failures in a contact portion between a connection portion provided at a terminal end of a wire and a counterpart connection portion

DESCRIPTION OF EMBODIMENTS

Figure 1:
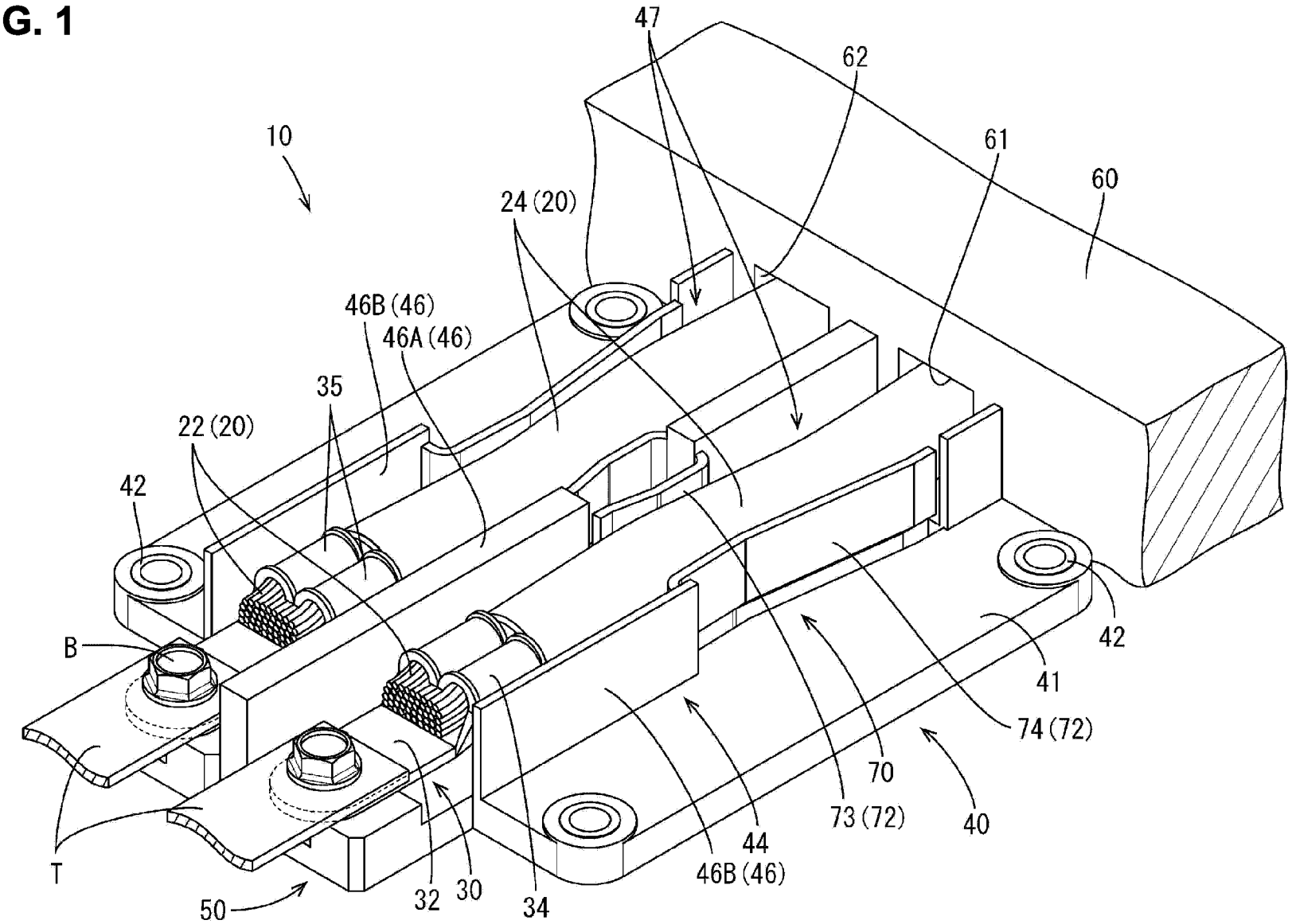
FIG. 1 is a perspective view of a wire routing unit according to Embodiment 1.

Description of Embodiments of the Present Disclosure

First, aspects of the present disclosure will be listed and described.

A terminal block according to the present disclosure is (1) a terminal block that electrically connects a connection portion provided at a terminal end of a wire and a counterpart connection portion to each other, the terminal block including: a contact placement portion on which the connection portion and the counterpart connection portion are disposed in contact with each other; a wire installation portion that is provided continuously with the contact placement portion and on which the wire is disposed; and a stress relaxation portion that is disposed between the wire installation portion and the wire so as to be elastically displaceable, and that bends and holds the wire in a state in which a clearance is provided between the wire and the wire installation portion.

With a terminal block having such a configuration, when the wire thermally expands due to heat generation or the like, the wire is further bent from the portion thereof that has already been bent, and the stress relaxation portion is elastically displaced to cause the wire to enter inside the clearance formed between the wire and the wire installation portion. This makes it possible to absorb the excess length resulting from the covered wire being extended due to thermal expansion.

On the other hand, when the wire thermally contracts due to cooling or the like, the stress relaxation portion is elastically displaced to cause the wire to enter the inside of the clearance formed between the wire and the wire installation portion, this making the bent wire straight. Thus, it is possible to inhibit a tensile stress in the axial direction from being applied to the wire. Accordingly, it is possible to inhibit stress due to thermal expansion or contraction of the wire from being applied to the contact portion between the connection portion and the counterpart connection portion. That is, when the wire thermally expands or contracts, it is possible to inhibit the occurrence of failures in the contact portion between the connection portion and the counterpart connection portion.

(2) It is preferable that the wire installation portion includes a plurality of side wall portions disposed along the wire, and the stress relaxation portion includes a plurality of elastic portions that are provided on the plurality of side wall portions so as to be elastically displaceable in a direction intersecting an axial direction of the wire, and that hold the wire in a bent state so as to provide a clearance between the wire and the side wall portions.

This allows the wire to be bent and held by the plurality of elastic portions between the plurality of side wall portions. When the wire thermally expands, the elastic portion is elastically displaced to cause the wire to enter the inside of the clearance between the wire and the side wall portion. When the wire thermally contracts, the stress relaxation portion is elastically displaced to cause the wire to enter the inside of the clearance between the wire and the side wall portions, thus making the bent wire straight. Therefore, in either the case where the wire is in a thermally expanded state or the case where the wire is in a thermally contracted state, it is possible to inhibit stress from being generated in the contact portion between the connection portion and the counterpart connection portion.

(3) It is preferable that the plurality of side wall portions are a pair of side wall portions disposed on opposite sides of the wire, the plurality of elastic portions are a pair of elastic portions provided in the same region in the axial direction of the wire, and one of the two elastic portions is configured as a large elastic portion protruding further toward the wire than the other.

(4) It is preferable that the wire installation portion includes a bottom wall portion on which the wire is mounted, and the pair of side wall portions extending from the bottom wall portion, and the pair of elastic portions are formed protruding in a cantilevered manner toward the wire from the side wall portions.

This allows the wire disposed between the pair of side wall portions to be bent by the pair of elastic portions, and it is thus possible to make the configuration of the terminal block simpler than in the case of providing three or more elastic portions, for example.

Since the pair of elastic portions are disposed in the same region in the axial direction, it is possible to reduce the size of the stress relaxation portion in the axial direction than when the pair of elastic portions are disposed offset in the axial direction, for example. Hence, it is possible to reduce the size of the terminal block in the axial direction.

Meanwhile, when the pair of elastic portions are disposed in the same region in the axial direction, and the pair of elastic portions come into contact with the wire from opposite sides in the axial direction, there is concern that the wire cannot be bent. However, since one of the two elastic portions is configured as the large elastic portion protruding further toward the wire than the other, the wire can be reliably bent by the large elastic portion toward the other elastic portion.

Since the pair of elastic portions are formed protruding in a cantilevered manner from the side wall portions toward the wire, the proportion of the wire to be bent can be easily adjusted by changing the dimensions in which the pair of elastic portions protrude from the side wall portions.

(5) It is preferable that the pair of elastic portions extend in a cantilevered manner in a direction intersecting the bottom wall portion.

With this configuration, when the pair of elastic portions extend in a cantilevered manner, for example, downward, which is a direction intersecting the bottom wall portion, the length dimension in the axial direction of the wire at the pair of elastic portions can be reduced as compared with that of an elastic portion extending in a cantilevered manner in the axial direction of the wire. Therefore, it is possible to reduce the size of the stress relaxation portion, and hence the terminal block, in the axial direction of the wire.

(6) It is preferable that the connection portion has a flat plate shape, and the terminal block includes: positioning portions that position the connection portion in a normal orientation by abutting against at least surfaces of opposite side edges of the connection portion; and an elastic pressing portion that urges the connection portion by coming into contact with a back surface of the connection portion.

With this configuration, when setting the connection portion on the terminal block, the surface of the flat plate-shaped connection portion that is urged by the elastic pressing portion toward the positioning portions abuts against the positioning portions at least at opposite side edges. Therefore, so-called displacement in a torsion direction of the connection portion, or displacement in which the connection portion rotates about the axis of the wire, is prevented. That is, although one of the opposite side edges of the connection portion is displaced obliquely upward when torsional force is applied to the flat plate-shaped connection portion, the connection portion is positioned in a normal orientation as a result of being pushed back by abutting against the positioning portions.

In particular, with the terminal block according to the present embodiment, there is a possibility that torsional force is applied to the connection portion due to the wire being bent and held by the stress relaxation portion. In addition, there is a possibility that torsional force is applied to the connection portion also when the wire has a large diameter and high bendability. In such a case, even if one of the opposite side edges of the flat plate-shaped connection portion is to be displaced in a torsion direction, the connection portion is held in a normal orientation as a result being pushed back by abutting against the positioning portions, and it is thus possible to advantageously prevent the occurrence of torsion in the connection portion.

As a result, the connection portion is positioned so as to be disposed in a normal orientation relative to the contact placement portion, thus facilitating the operation of connecting the connection portion to the counterpart connection portion. Stress due to the rotational displacement in a torsion direction of the connection portion is also prevented from acting on the connection portion between the connection portion and the counterpart connection portion.

(7) It is preferable that leg portions are provided that are disposed on opposite sides in a width direction of the connection portion and are elastically deformable outwardly in the width direction of the connection portion, and the positioning portions are formed protruding from the leg portions.

With this configuration, when the connection portion is pushed in while pressing the opposite side ends of the connection portion on the back surface onto the positioning portions, for example, the leg portions are elastically deformed outward in the width direction of the connection portion, and the positioning portions move outward in the width direction of the connection portion. Therefore, through a simple operation of pushing in the connection portion, the connection portion can be inserted between the positioning portions and the elastic pressing portion.

Preferably, each of the positioning portions is provided with a pressing guide surface that elastically deforms the elastic leg portion through the above-described pressing of the connection portion, thus moving the positioning portion outward in the width direction of the connection portion. With this configuration, by pushing in the connection portion while pressing the opposite side ends of the connection portion on the back surface side onto the pressing guide surfaces of the positioning portions, the leg portions can be easily elastically deformed outward in the width direction of the connection portion, thus allowing the connection portion to be more easily inserted between the positioning portions and the elastic pressing portion.

(8) It is preferable that the elastic pressing portion is formed as a single piece with the contact placement portion.

This configuration reduces the number of components, and thus may simplify the structure.

(9) It is preferable that the positioning portions are provided on opposite sides in a length direction of the connection portion relative to the elastic pressing portion.

With this configuration, displacement in a twisting direction of the connection portion is less likely to occur in a state in which the connection portion is pressed onto the positioning portions by the elastic pressing portion. Since not only displacement in a torsion direction, but also displacement in a twisting direction of the connection portion is restricted, the connection portion can be more easily held in a normal set state in which the connection portion is positioned in a normal orientation relative to the contact placement portion.

Note that the contact placement portion may be provided with a guide surface that guides the connection portion during attachment of the connection portion.

With this configuration, the connection portion is guided by the guide surface to a normal set position of the contact placement portion, and therefore an attachment operation for setting the connection portion on the contact placement portion is facilitated.

(10) A wire routing unit including: the above-described terminal block; and an enclosure portion that accommodates the wire pulled out from the wire installation portion of the terminal block to a side opposite to the contact placement portion, wherein the wire accommodated in the enclosure portion and a wall portion of the enclosure portion are disposed in proximity to each other.

The wire that is accommodated in the enclosure portion and is in proximity to the wall portion is close to the wall portion. Accordingly, when the wire thermally expands, the wire accommodated in the enclosure portion cannot be bent, and the amount of thermal expansion of the wire is accumulated to extend to the position of the wire installation portion of the terminal block.

That is, when the wall portion of the enclosure portion that accommodates the wire and the wire are in proximity to each other, the technique by which the stress relaxation portion absorbs the excess length of the thermally expanded covered wire is highly effective.

Details of Embodiments of the Present Disclosure

Specific examples of the terminal block and the wire routing unit according to the present disclosure will be described below with reference to the drawings. It should be noted that the present disclosure is not limited to these examples, but is defined by the claims, and is intended to include all modifications which fall within the scope of the claims and the meaning and scope of equivalents thereof.

Embodiment 1

Embodiment 1 of the present disclosure will be described with reference to FIGS. 1 to 10.

Embodiment 1 of the present disclosure illustrates a wire routing unit 10 that is connected to a device-side connection portion (an example of a "counterpart connection portion") T of a device mounted to a vehicle.

Figure 2:
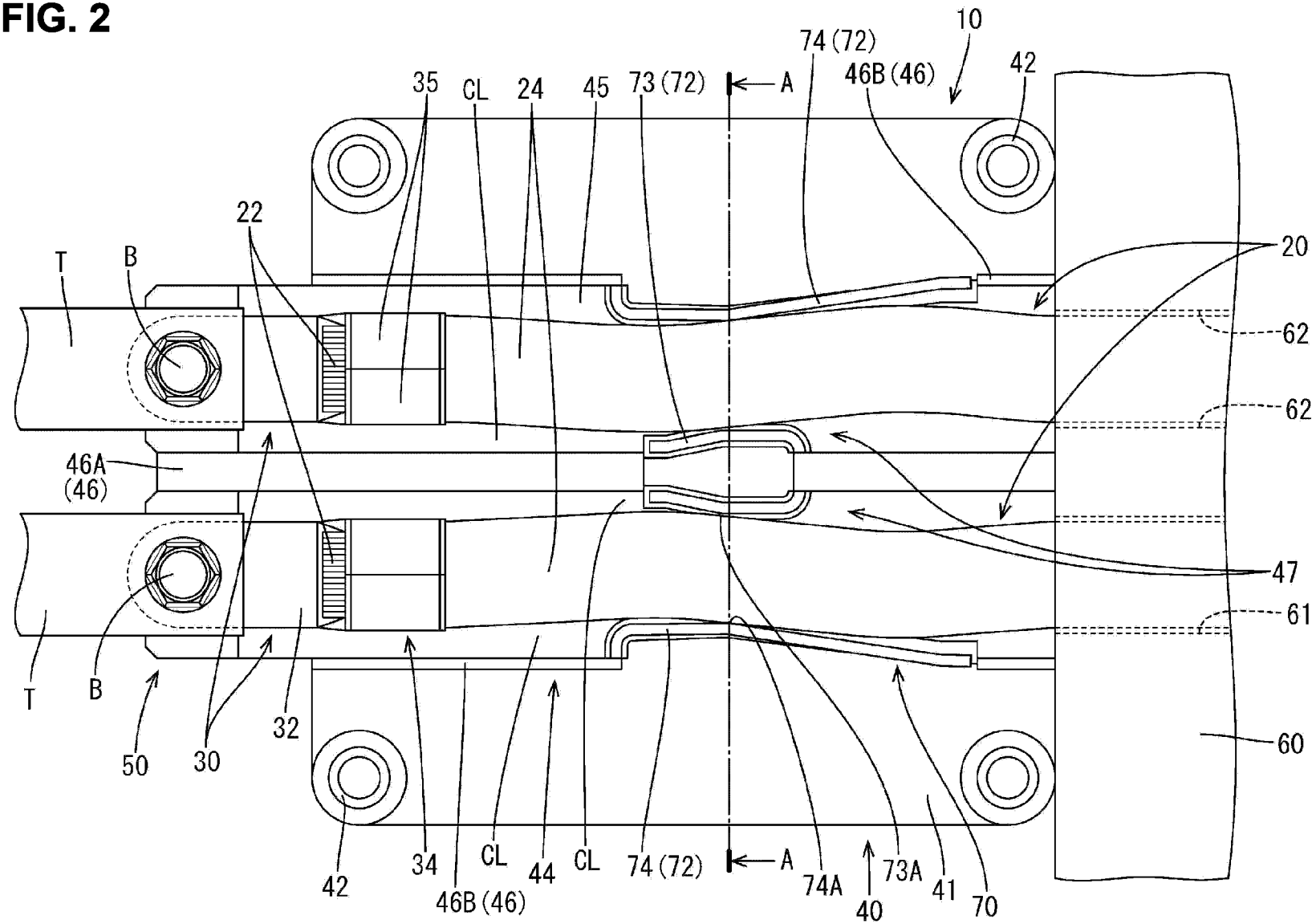
FIG. 2 is a plan view of the wire routing unit.

As shown in FIGS. 1 and 2, a pair of device-side connection portions T have a flat plate shape and are arranged in the left-right direction.

As shown in FIGS. 1 and 2, the wire routing unit 10 includes a pair of covered wires 20, a pair of terminals 30 connected to front-side terminal ends of the pair of covered wires 20, a terminal block 40 on which the front-side terminal end portions of the pair of covered wires 20 and the pair of terminals 30 are disposed, and an enclosure portion 60 that accommodates the covered wires 20 that are pulled out rearward from the terminal block 40.

Each covered wire 20 is formed by a core wire 22 constituted by a conductive stranded wire being covered with an insulating covering 24. For the core wire 22, it is possible to use any material such as copper, a copper alloy, aluminum, or an aluminum alloy. At a front end portion of the covered wire 20, the insulating covering 24 is stripped off such that the core wire 22 is exposed.

Each terminal 30 is formed by processing a conductive metal plate material by pressing or the like, and has a smaller cross-sectional area than the covered wire 20. For the terminal 30, it is possible to use any material such as copper, a copper alloy, aluminum, or an aluminum alloy. The terminal 30 includes a terminal connection portion (an example of a "connection portion") 32 that is connected to the device-side connection portion T, and a wire connection portion 34 that is connected to the core wire 22 of the covered wire 20.

The terminal connection portion 32 has a flat plate shape, and the wire connection portion 34 is formed rearward of the terminal connection portion 32 so as to be continuous therewith.

The wire connection portion 34 includes a pair of barrels 35, and is electrically connected to the front end portion of the covered wire 20 by the pair of barrels 35 being crimped to the core wire 22 of the covered wire 20.

The terminal block 40 is generally made of a synthetic resin, and includes an attachment plate 41 having a substantially square shape in a plan view, and a pair of contact placement portions 50 protruding forward from the attachment plate 41. The attachment plate 41 has a flat plate shape, and a metal collar 42 through which an attachment bolt (not shown) is passed is embedded in each of the four corners of the attachment plate 41.

A substantially central portion of the attachment plate 41 in the left-right direction is configured as a wire installation portion 44 on which the pair of covered wires 20 are disposed extending in the front-rear direction.

The wire installation portion 44 includes a bottom wall portion 45 that is elongated long in the front-rear direction, and a plurality of side wall portions 46 extending upward from the bottom wall portion 45.

The bottom wall portion 45 is formed extending along the entire length of the attachment plate 41 in the front-rear direction, and the wire connection portions 34 of the pair of terminals 30 and the front end portions of the pair of covered wires 20 can be mounted on the bottom wall portion 45 so as to be disposed side by side in the left-right direction.

The plurality of side wall portions 46 are provided at a total of three positions, namely, between the pair of covered wires 20 mounted on the bottom wall portion 45, and on opposite sides of the pair of covered wires 20 in the left-right direction.

The side wall portions 46 are shaped to extend linearly in the front-rear direction along the covered wire 20, and are formed over the entire length of the bottom wall portion 45 in the front-rear direction.

Of the plurality of side wall portions 46, a central side wall portion 46A disposed between the pair of covered wires 20 is set to have a larger thickness dimension than outer side wall portions 46B disposed on opposite sides of the pair of covered wires 20 in the left-right direction. The central side wall portion 46A protrudes forward from the attachment plate 41, and is shaped to extend to the front end positions of the terminal connection portions 32 of the pair of terminals 30 that protrude forward from the bottom wall portion 45. Accordingly, the central side wall portion 46A serves as an insulating wall for providing insulation between the pair of terminals 30 disposed on the bottom wall portion 45.

The dimension in the left-right direction between the central side wall portion 46A and each outer side wall portion 46B is set to be larger than the outer diameter dimension of the covered wire 20. When the covered wire 20 is disposed between the central side wall portion 46A and the outer side wall portion 46B, a clearance CL is formed between the covered wires 20 and each of the side wall portions 46.

That is, as shown in FIGS. 1 to 10, the wire installation portion 44 has two wire routing paths 47 formed by the bottom wall portion 45, the central side wall portion 46A, and the outer side wall portions 46B. When one of the covered wires 20 is installed in each of the wire routing paths 47, a clearance CL is formed between the covered wire 20 and each of the side wall portions 46, as shown in FIGS. 1 and 2.

The pair of contact placement portions 50 have a flat plate shape. The pair of contact placement portions 50 are shaped to protrude forward from a front edge of the attachment plate 41 so as to extend along the central side wall portion 46A, and each of the contact placement portions 50 extends continuously with a front edge of the bottom wall portion 45 that is disposed between the central side wall portion 46A and the outer side wall portions 46B of the wire installation portion 44, and with the central side wall portion 46A.

Figure 4:
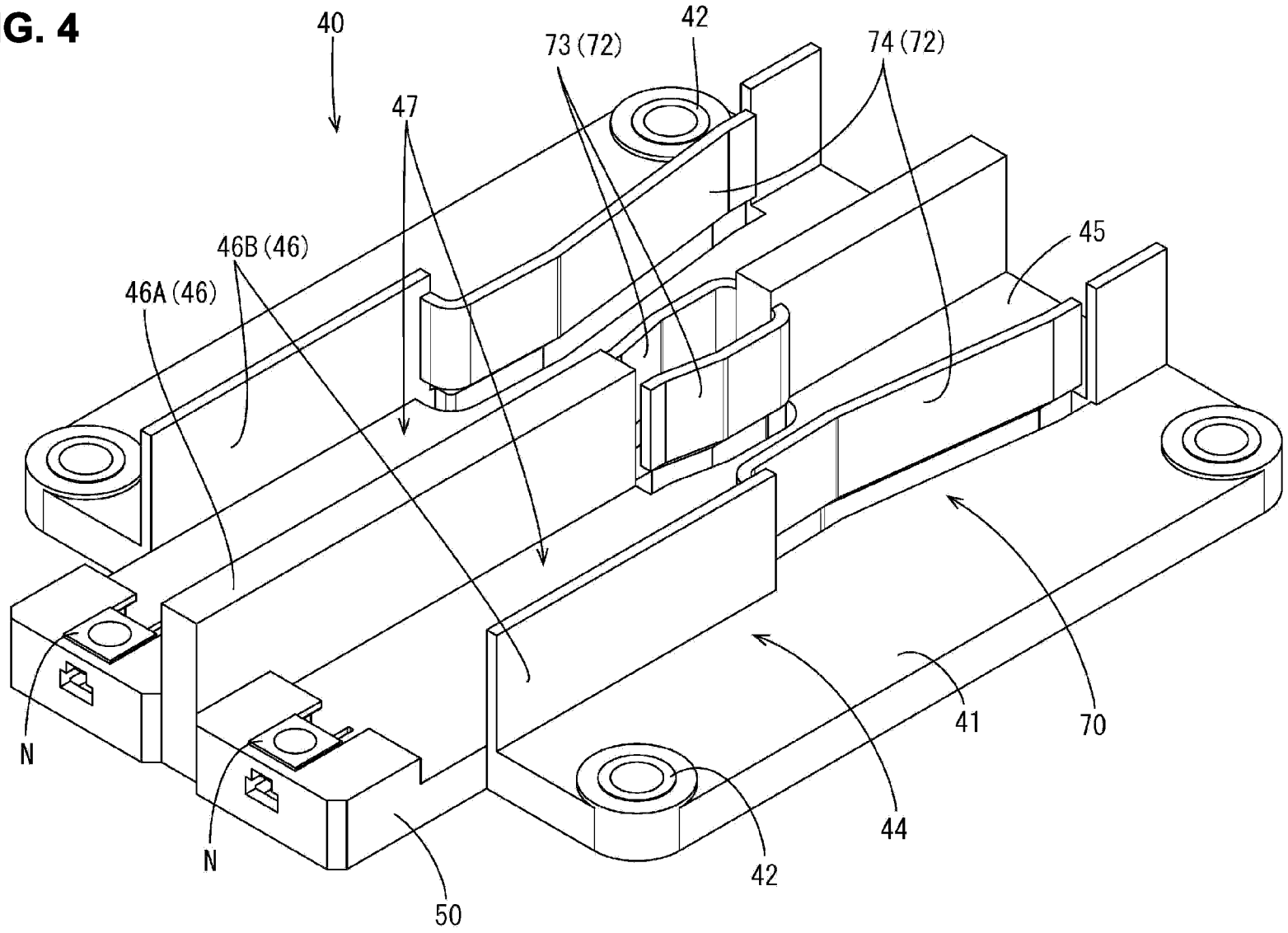
FIG. 4 is a perspective view of a terminal block according to Embodiment 1.
Figure 5:
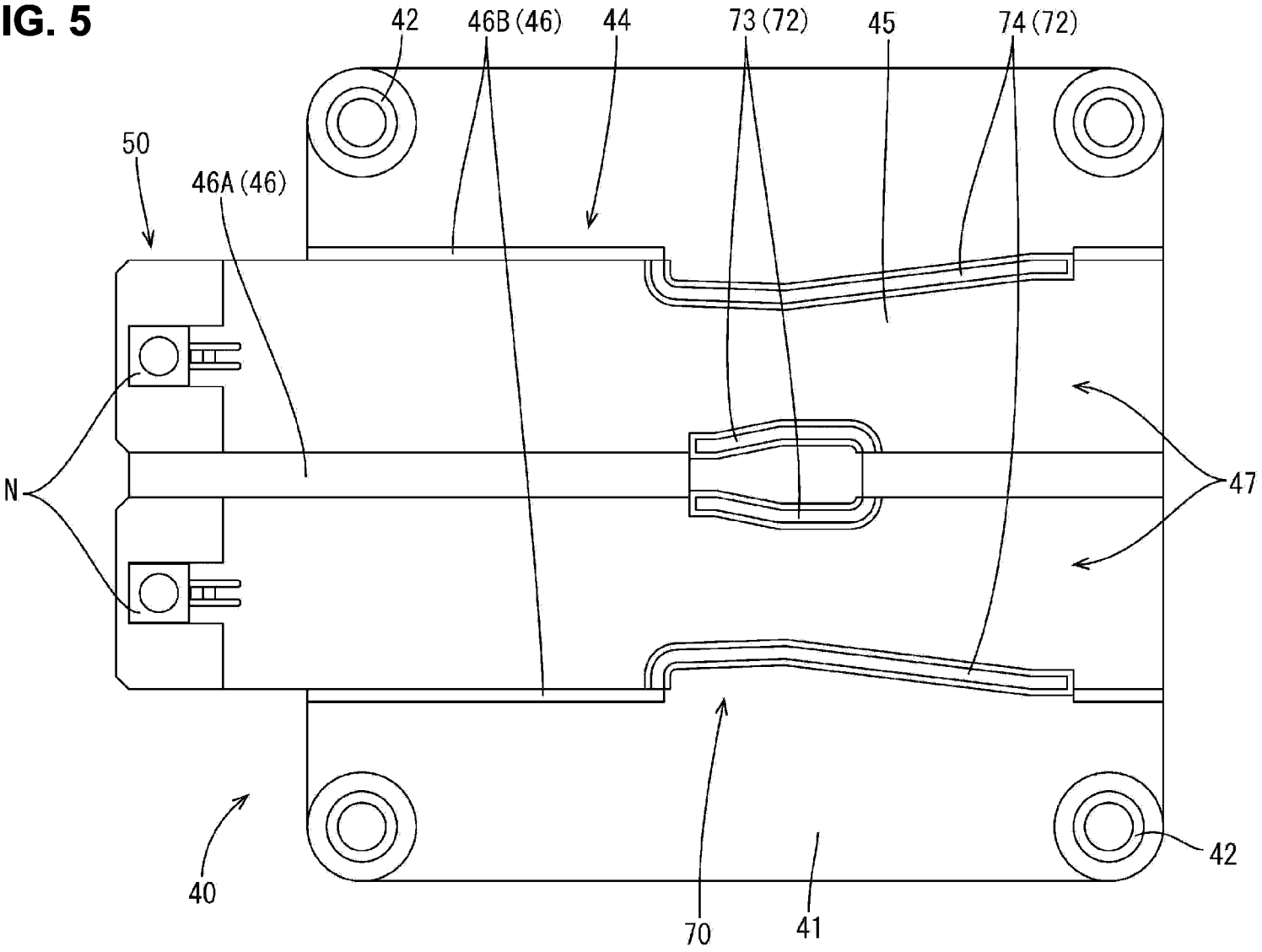
FIG. 5 is a plan view of the terminal block.
Figure 6:
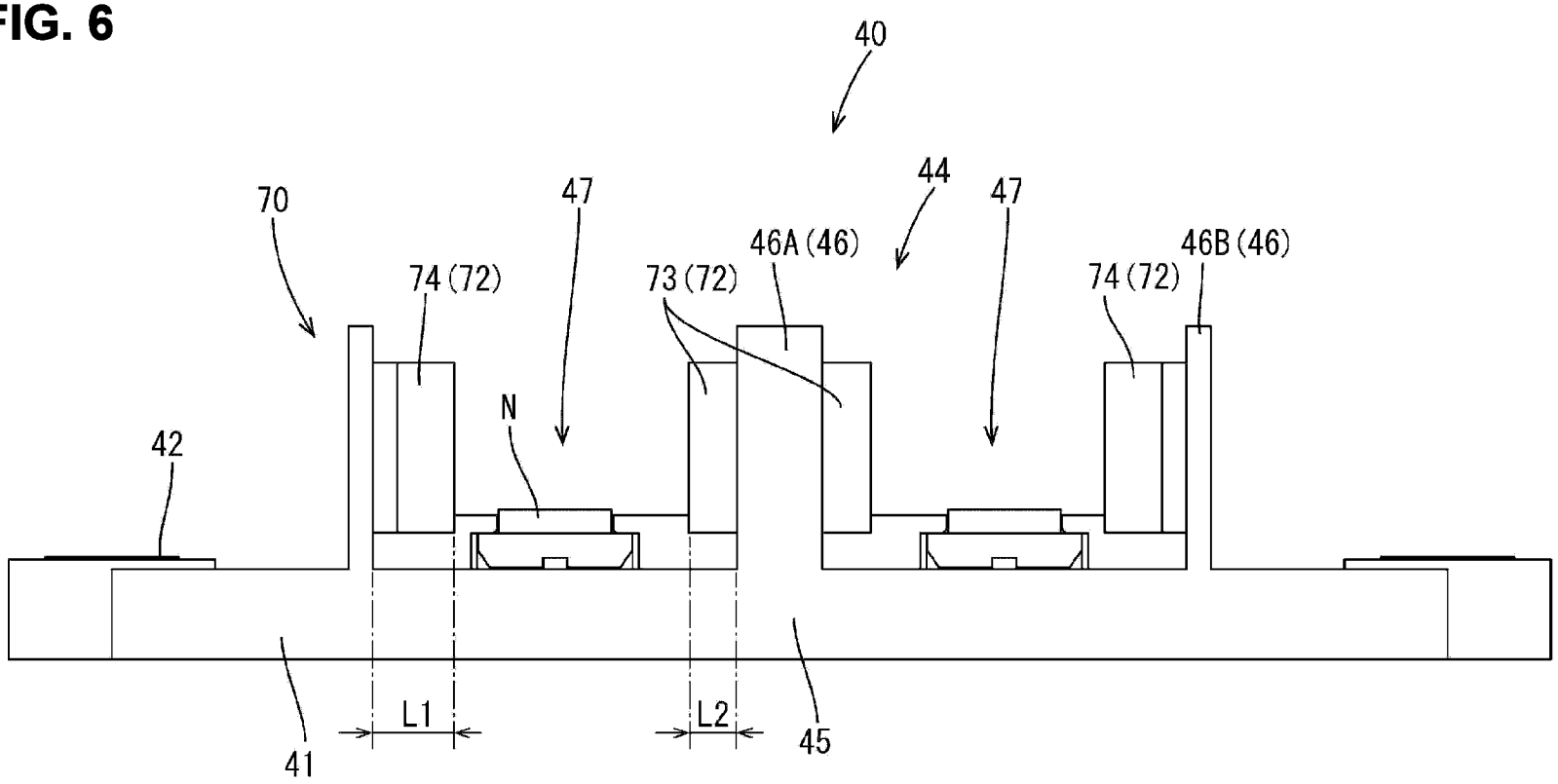
FIG. 6 is a rear view of the terminal block.

As shown in FIGS. 4 to 6, a nut N is fixed at a front end part of each of the contact placement portions 50, and the terminal connection portion 32 of the terminal 30 and the device-side connection portion T can be mounted on the nut N so as to be overlapped on top of each other. As shown in FIGS. 1 and 2, a fastening bolt B is passed through the terminal connection portion 32 and the device-side connection portion T disposed overlapping on the nut N, and is then fastened to the nut N, whereby the terminal connection portion 32 and the device-side connection portion T are electrically connected to each other.

Meanwhile, the pair of covered wires 20 that are pulled out rearward from a rear end of the wire installation portion 44 are accommodated in wire accommodating portions 61 provided in the enclosure portion 60.

Each of the wire accommodating portions 61 is formed by four wall portions 62 that cover the corresponding covered wire 20 from four directions, namely, from above, below, left, and right, and each of the covered wires 20 is separately surrounded by the four wall portions 62. Each of the wall portions 62 in the wire accommodating portion 61 is disposed in proximity to the covered wire 20, and the wall portions 62 and the covered wire 20 are close to each other.

As shown in FIGS. 1 to 6, a stress relaxation portion 70 that bends and holds the covered wire 20 is disposed between each covered wire 20 mounted on the bottom wall portion 45 and each of the outer side wall portions 46B and the central side wall portion 46A of the wire installation portion 44.

Each stress relaxation portion 70 includes a plurality of elastic portions 72 provided respectively at the outer side wall portion 46B and the corresponding central side wall portion 46A.

The elastic portions 72 of Embodiment 1 are provided respectively at the corresponding outer side wall portion 46B and the central side wall portion 46A so as to be disposed in the same region in the front-rear direction, and the pair of elastic portions 72 come into contact, from opposite sides, with the same region, in the front-rear direction, of the covered wire 20 disposed in the wire routing path 47.

The elastic portion 72 provided on the central side wall portion 46A is configured as a small elastic portion 73 protruding into the wire installation portion 44, and then extending forward in a cantilevered manner. On the other hand, the elastic portion 72 provided on the outer side wall portion 46B is configured as a large elastic portion 74 protruding into the wire installation portion 44, and then extending rearward in a cantilevered manner.

Figure 3:
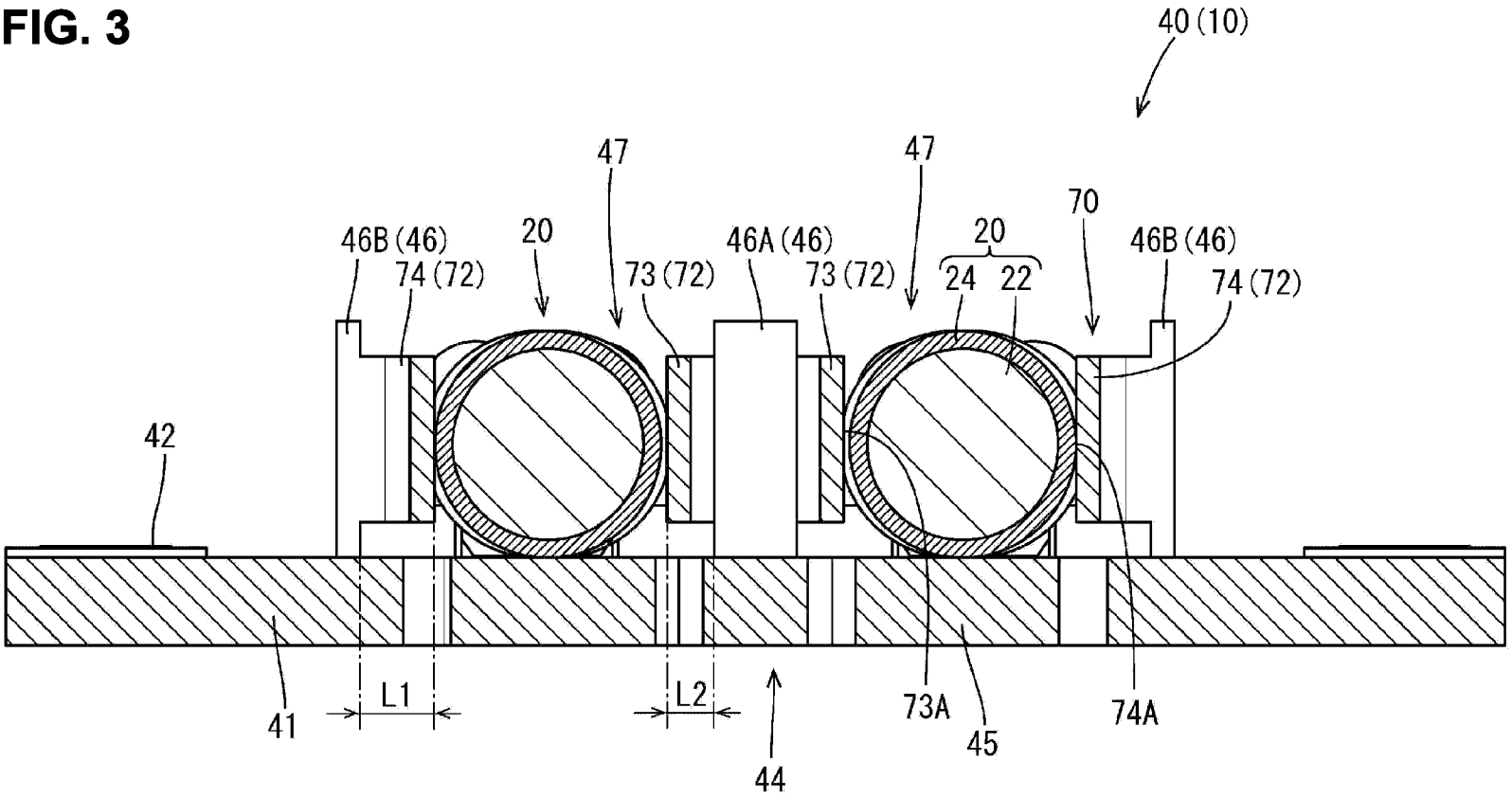
FIG. 3 is a cross-sectional view taken along the line A-A in FIG. 2.

As shown in FIGS. 3 and 6, the large elastic portion 74 is formed so as to have an amount of protrusion L1 into the wire installation portion 44 that is larger than an amount of protrusion L2 of the small elastic portion 73 into the wire installation portion 44, and to be elongated in the front-rear direction.

The distance between a part 74A of the large elastic portion 74 that comes into contact with the covered wire 20 and a part 73A of the small elastic portion 73 that comes into contact with the covered wire 20 is set to be the same as the outer diameter of the covered wire 20. Here, the same dimension may mean that the distance between the part 74A of the large elastic portion 74 that comes into contact with the covered wire 20 and the part 73A of the small elastic portion 73 that comes into contact with the covered wire 20 is the same as the outer diameter dimension of the covered wire 20, and also include a case where the distance can be recognized to be substantially the same as the outer diameter dimension even if it is not the same.

Accordingly, when the covered wire 20 is disposed between the outer side wall portion 46B and the central side wall portion 46A, the covered wire 20 extends along, and comes into contact with, the large elastic portion 74 protruding further to the covered wire 20 side than the small elastic portion 73 side, and is bent toward the central side wall portion 46A side, as shown in FIG. 2. Thus, the covered wire 20 is disposed so as to be held by the large elastic portion 74 and the small elastic portion 73 from opposite sides in the left-right direction in a state in which the covered wire 20 is bent toward the central side wall portion 46A side. In addition, the covered wire 20 comes into contact with the small elastic portion 73 so as to extend along therewith, and is disposed in the wire installation portion 44 in a state in which a clearance CL is provided between the covered wire 20 and the central side wall portion 46A.

The configuration according to Embodiment 1 is as described above. Next, the operation and effects of the wire routing unit 10 will be described.

For instance, when the wire routing unit is used, for example, for large current and high voltage applications, if the covered wire is exposed to the heat generated by itself, the heat conducted from the contact portion with the device-side connection portion T, and so forth, the covered wire, which has a larger cross-sectional area than the terminal, undergoes a significant change in its length in the axial direction due to thermal expansion or contraction. Accordingly, the terminal connection portion connected to the covered wire is pushed or pulled in the front-rear direction, which is the axial direction of the covered wire, and there is concern that stress may be concentrated on the contact portion between the terminal connection portion and the device-side connection portion, thus resulting in a failure in the contact portion.

Therefore, in order to solve the above-described problem, the present inventors have conducted intensive studies, and, as a result, have found the configuration of the present embodiment. That is, as shown in FIGS. 1 and 2, the present embodiment is a terminal block 40 that electrically connects a terminal connection portion 32 provided at a terminal end of a covered wire 20 and a device-side connection portion T provided in a device to each other, the terminal block 40 including: a contact placement portion 50 on which the terminal connection portion 32 and the device-side connection portion T are disposed in contact with each other; a wire installation portion 44 that is provided continuously with the contact placement portion 50 and on which the covered wire 20 is disposed; and a stress relaxation portion 70 that is disposed between the wire installation portion 44 and the covered wire 20 so as to be elastically displaceable, and that bends and holds the covered wire 20 in a state in which a clearance CL is provided between the covered wire 20 and the wire installation portion 44.

Figure 7:
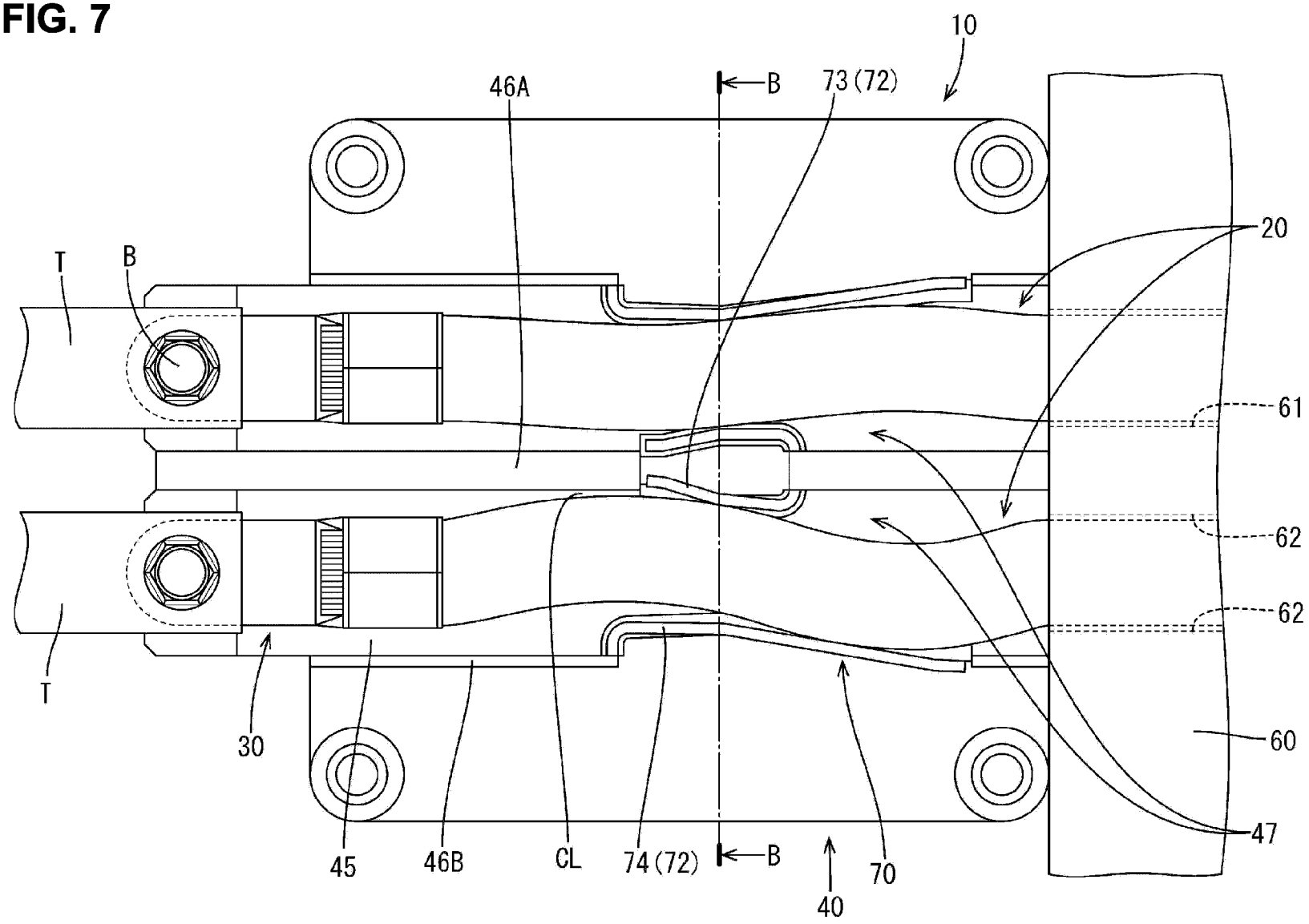
FIG. 7 is a plan view showing a state in which one wire has thermally expanded in the wire routing unit.
Figure 8:
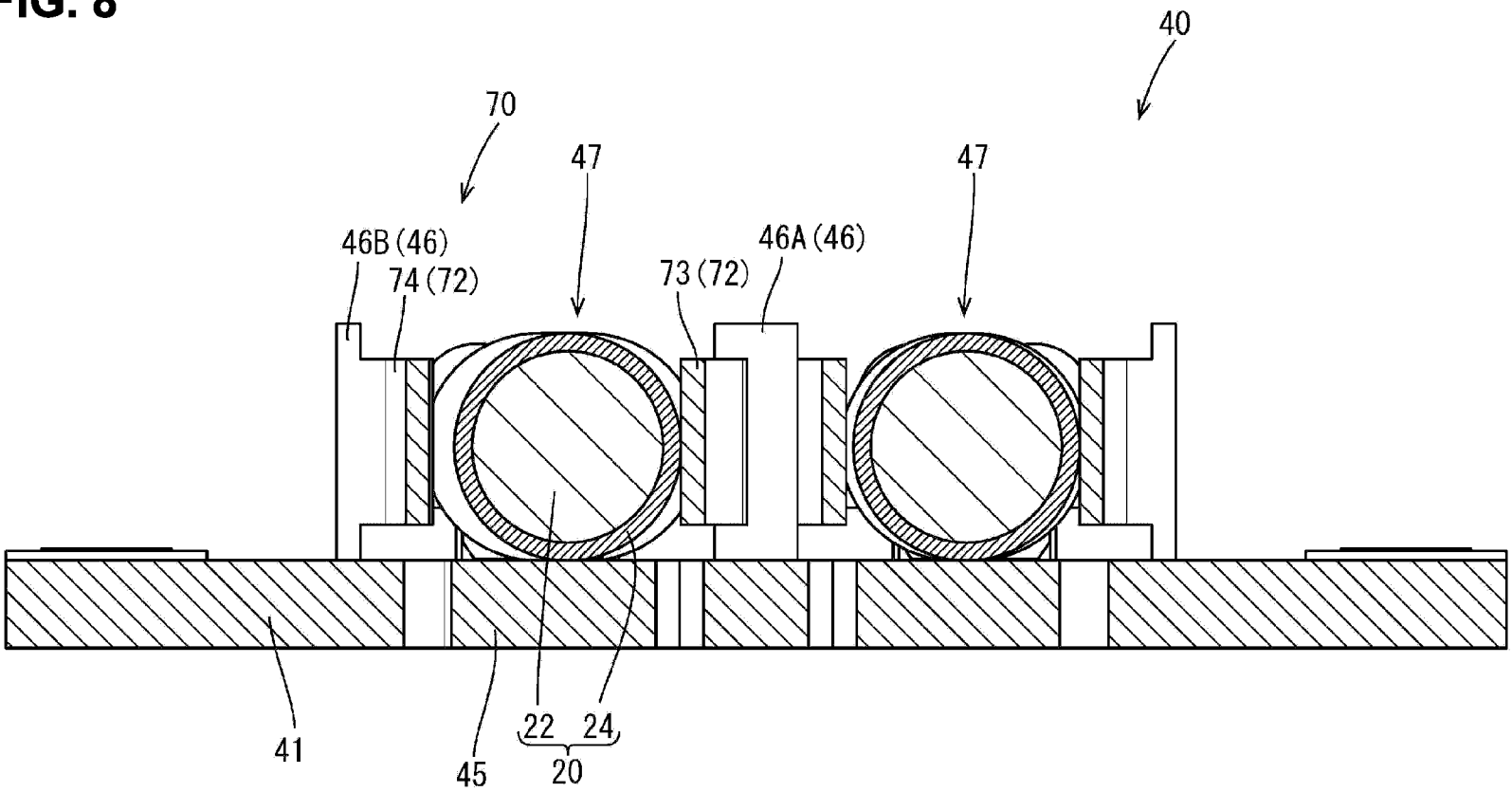
FIG. 8 is a cross-sectional view taken along the line B-B in FIG. 7.

Therefore, in the terminal block 40 according to Embodiment 1, when the covered wire 20 thermally expands due to heat generation or the like, the covered wire 20 is further bent from the portion thereof that has already been bent, as shown in FIGS. 7 and 8. Then, the stress relaxation portion 70 is elastically displaced to cause the covered wire 20 to enter the clearance CL formed between the covered wire 20 and the wire installation portion 44, thus making it possible to absorb the excess length resulting from the thermal expansion of the covered wire 20. Note that in FIGS. 7 and 8, in order to clearly differentiate between the thermally expanded state and the thermally unexpanded state of the covered wire 20, the covered wire 20 on the right side (the upper side in the drawing) shows the thermally unexpanded state, and the covered wire 20 on the left side (the lower side in the drawing) shows the thermally expanded state.

Figure 9:
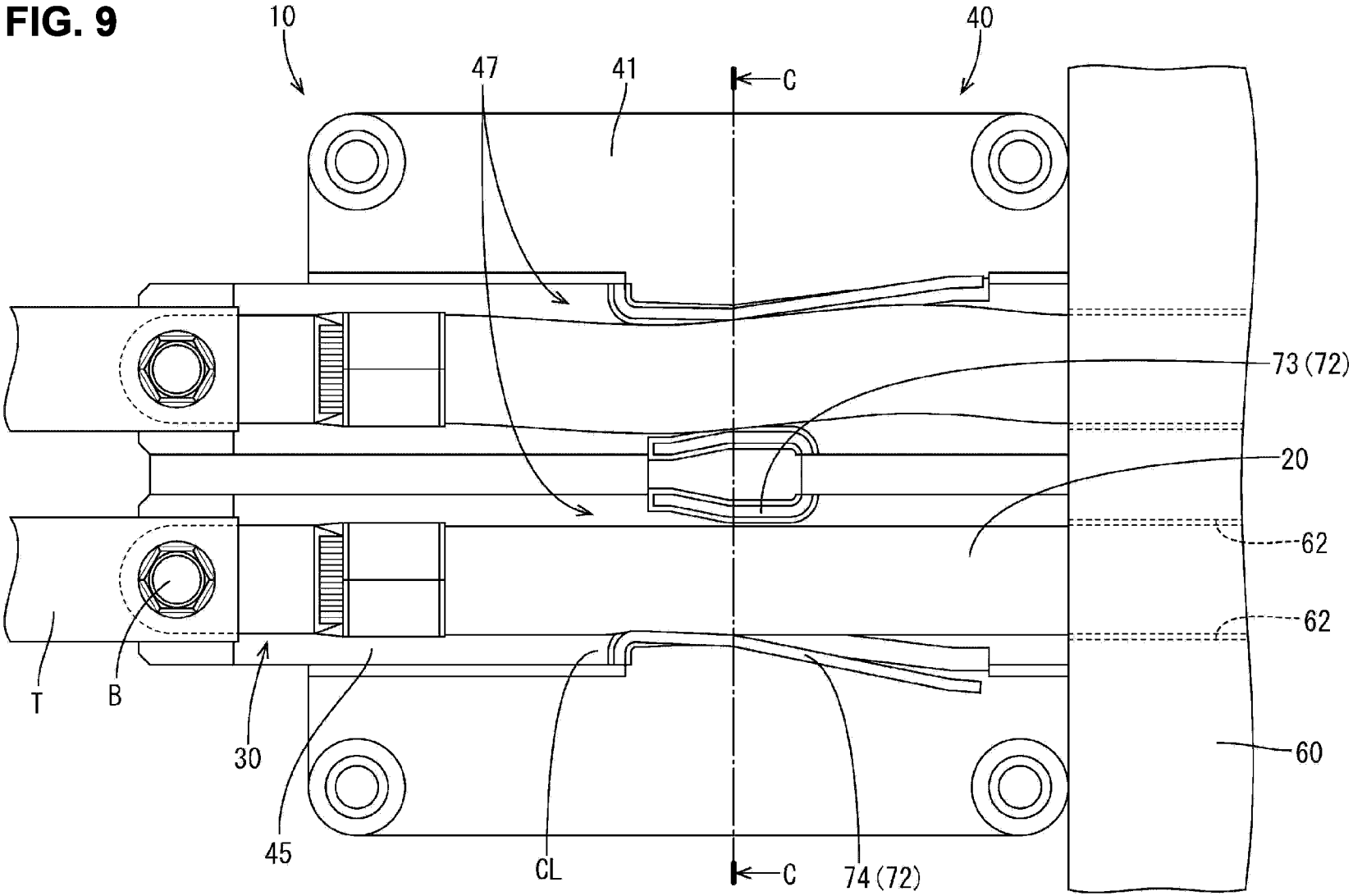
FIG. 9 is a plan view showing a state in which one wire has thermally contracted in the wire routing unit.
Figure 10:
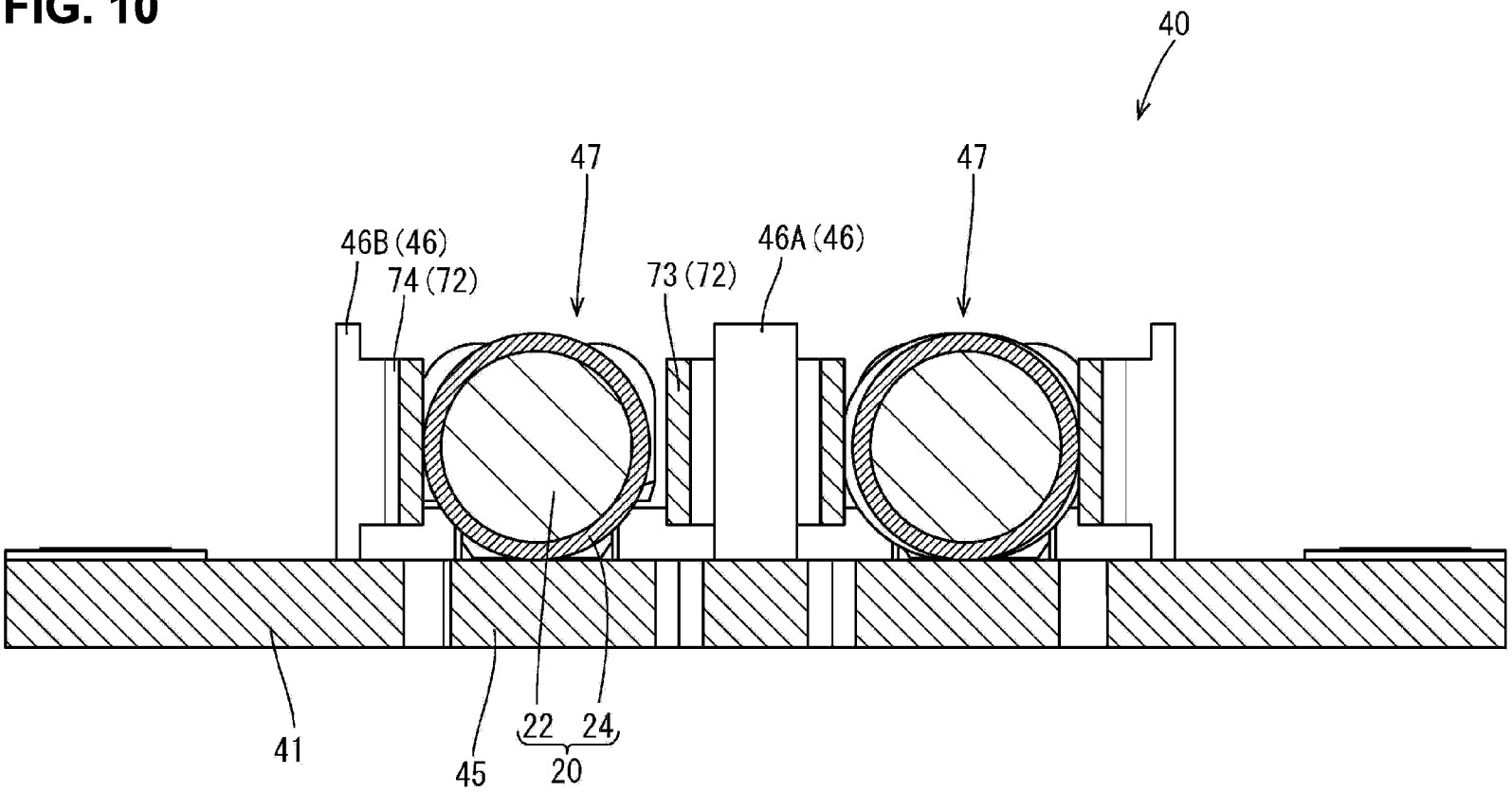
FIG. 10 is a cross-sectional view taken along the line C-C in FIG. 9.
Figure 11:
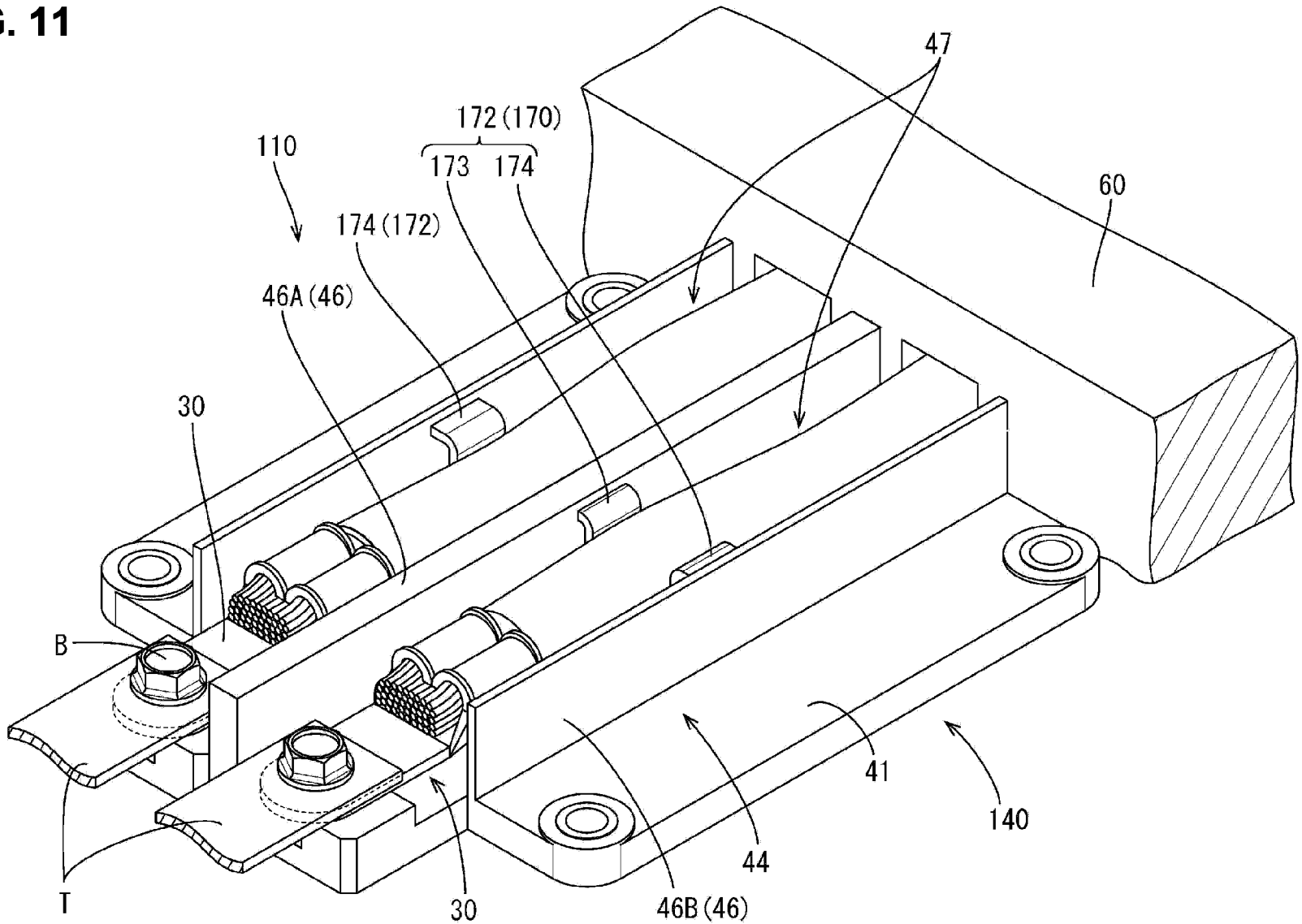
FIG. 11 is a perspective view of a wire routing unit according to Embodiment 2.
Figure 12:
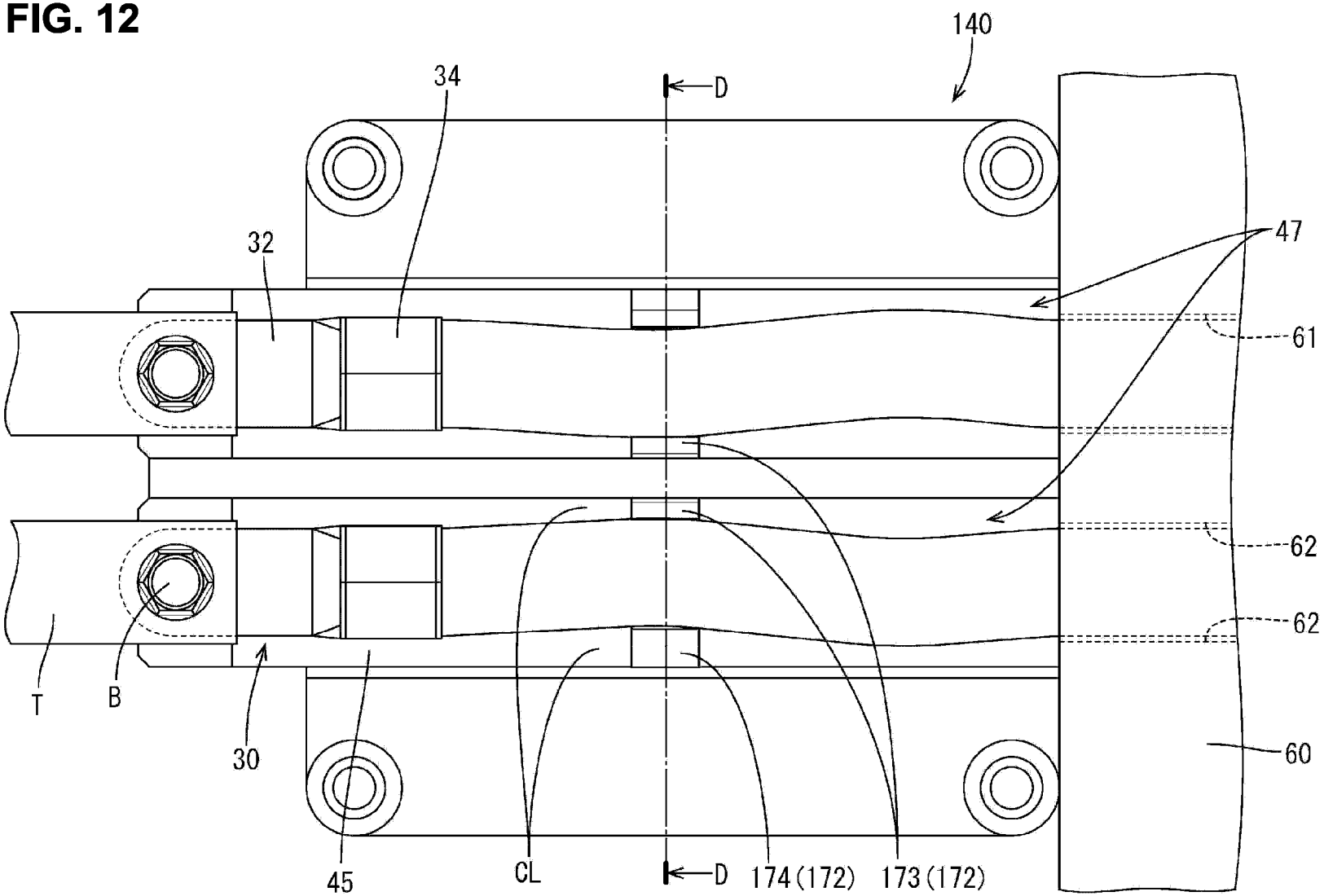
FIG. 12 is a plan view of the wire routing unit.

On the other hand, when the covered wire 20 thermally contracts due to cooling or the like, as shown in FIGS. 9 and 10, the stress relaxation portion 70 is elastically displaced to cause the covered wire 20 to enter the clearance CL between the covered wire 20 and the wire installation portion 44. This makes the bent covered wire 20 straight, and it is thus possible to inhibit a tensile stress in the axial direction from being applied to the covered wire 20. Note that in FIGS. 9 and 10, in order to clearly differentiate between the thermally contracted state and the thermally uncontracted state of the covered wire 20, the covered wire 20 on the right side (the upper side in the drawing) shows the thermally uncontracted state, and the covered wire 20 on the left side (the lower side in the drawing) shows the thermally contracted state.

That is, it is possible to inhibit the stress due to thermal expansion or contraction of the covered wire 20 from being applied to the contact portion between the terminal connection portion 32 and the device-side connection portion T. This makes it possible to inhibit the occurrence of failures in the contact portion between the terminal connection portion 32 and the device-side connection portion T.

The wire installation portion 44 includes a plurality of side wall portions 46 disposed along the covered wire 20. The stress relaxation portion 70 includes a plurality of elastic portions 72 that are provided on the plurality of side wall portions 46 so as to be elastically displaceable in the left-right direction, which is a direction intersecting the axial direction of the covered wire 20, and that hold the covered wire 20 in a bent state in a state in which a clearance CL is provided between the covered wire 20 and the side wall portions 46.

This allows the covered wire 20 to be bent and held by the plurality of elastic portions 72 between the plurality of side wall portions 46. When the covered wire 20 thermally expands, the elastic portion (small elastic portion 73) 72 is elastically displaced toward the side wall portion (central side wall portion 46A) 46 side, as shown in FIGS. 7 and 8. This allows the covered wire 20 to enter inside the clearance CL formed between the covered wire 20 and the side wall portion (central side wall portion 46A) 46, thus absorbing the excess length resulting from the thermal expansion.

On the other hand, when the covered wire 20 thermally contracts, the elastic portion (large elastic portion 74) 72 is elastically displaced toward the side wall portion (outer side wall portion 46B) 46 side, as shown in FIGS. 9 and 10. This allows the covered wire 20 to enter the inside of the clearance CL between the side wall portion (outer side wall portion 46B) and the covered wire 20. This makes the bent covered wire 20 straight, and it is thus possible to inhibit tensile stress from being applied to the covered wire 20.

Therefore, when the covered wire 20 thermally expands or contracts, it is possible to inhibit stress from being generated in the contact portion between the terminal connection portion 32 and the device-side connection portion T.

When the covered wire 20 has thermally contracted to become straight, the covered wire 20 and the elastic portion (small elastic portion 73) are spaced apart in the left-right direction.

The plurality of side wall portions 46 are formed by the pair of side wall portions 46 disposed on opposite sides of the covered wire 20 in the left-right direction. As shown in FIGS. 1 to 6, the plurality of elastic portions 72 are formed by the pair of elastic portions 72 provided in the same region in the front-rear direction of the covered wire 20, and one of the two elastic portions 72 is configured as a large elastic portion 74 protruding further toward the covered wire 20 than the other.

This allows the covered wire 20 disposed between the pair of side wall portions 46 to be bent by the pair of elastic portions 72, and it is therefore possible to make the configuration of the terminal block 40 simpler than in the case of providing three or more elastic portions, for example.

According to Embodiment 1, the pair of elastic portions 72 are disposed in the same region in the front-rear direction, and it is therefore possible to make the size of the stress relaxation portion 70 in the front-rear direction smaller than when the pair of elastic portions are disposed offset in the front-rear direction, for example. Hence, it is possible to reduce the size of the terminal block 40 in the front-rear direction.

Meanwhile, when the pair of elastic portions 72 are disposed in the same region in the front-rear direction, there is concern that the covered wire 20 cannot be bent if the pair of elastic portions 72 come into contact with the covered wire 20 from opposite sides. However, according to Embodiment 1, one of the two elastic portions 72 is configured as the large elastic portion 74 protruding further toward the covered wire 20 than the other.

That is, the amount of protrusion L1 of the large elastic portion 74 from the outer side wall portion 46B is set to be larger than the amount of protrusion L2 of the small elastic portion 73 from the central side wall portion 46A. Accordingly, the covered wire 20 can be reliably bent toward the small elastic portion 73 side by the large elastic portion 74.

The wire installation portion 44 includes the bottom wall portion 45 on which the covered wire 20 is mounted, and the pair of side wall portions 46 extending from the bottom wall portion 45, and the pair of elastic portions 72 are formed protruding in a cantilevered manner from the side wall portions 46 toward the covered wire 20.

Accordingly, the pair of elastic portions 72 protrude in a cantilevered manner from the side wall portions 46 toward the covered wire 20, and therefore the proportion of the covered wire 20 to be bent can be easily adjusted by adjusting the dimensions in which the pair of elastic portions 72 protrude from the side wall portions 46.

Furthermore, as shown in FIGS. 1 and 2, the wire routing unit 10 includes the enclosure portion 60 that accommodates the covered wire 20 pulled out rearward, which is the side opposite to the contact placement portion 50, from the wire installation portion 44 of the terminal block 40, and the covered wire 20 accommodated in the enclosure portion 60 and the wall portions 62 of the enclosure portion 60 are disposed in proximity to each other.

That is, the covered wire 20 accommodated in the enclosure portion 60 is surrounded by the wall portions 62, and each of the wall portions 62 and the covered wire 20 are close to each other. Accordingly, when the covered wire 20 thermally expands, the covered wire 20 accommodated in the enclosure portion 60 cannot be bent, and the amount of thermal expansion of the covered wire 20 is accumulated to extend to the position of the wire installation portion 44 of the terminal block 40. Therefore, when the wall portions 62 of the enclosure portion 60 that accommodates the covered wire 20 and the covered wire 20 are in proximity to each other, the technique by which the stress relaxation portion 70 absorbs the excess length of the thermally expanded covered wire 20 is highly effective.

Embodiment 2

Next, Embodiment 2 will be described with reference to FIGS. 11 to 14.

A stress relaxation portion 170 of a terminal block 140 of a wire routing unit 110 according to Embodiment 2 is formed by changing the shape of the pair of elastic portions 72 of the stress relaxation portion 70 according to Embodiment 1. The description of the components, function, and effect that are common to Embodiment 1 is redundant and therefore has been omitted. In addition, components that are the same as those of Embodiment 1 are denoted by the same reference numerals.

As shown in FIGS. 11 to 14, a pair of elastic portions 172 according to Embodiment 2 are formed protruding toward the inside of the wire installation portion 44 from a central side wall portion 46A and an outer side wall portion 46B, and then extending in a cantilevered manner downward, which is a direction intersecting the bottom wall portion 45.

Figure 13:
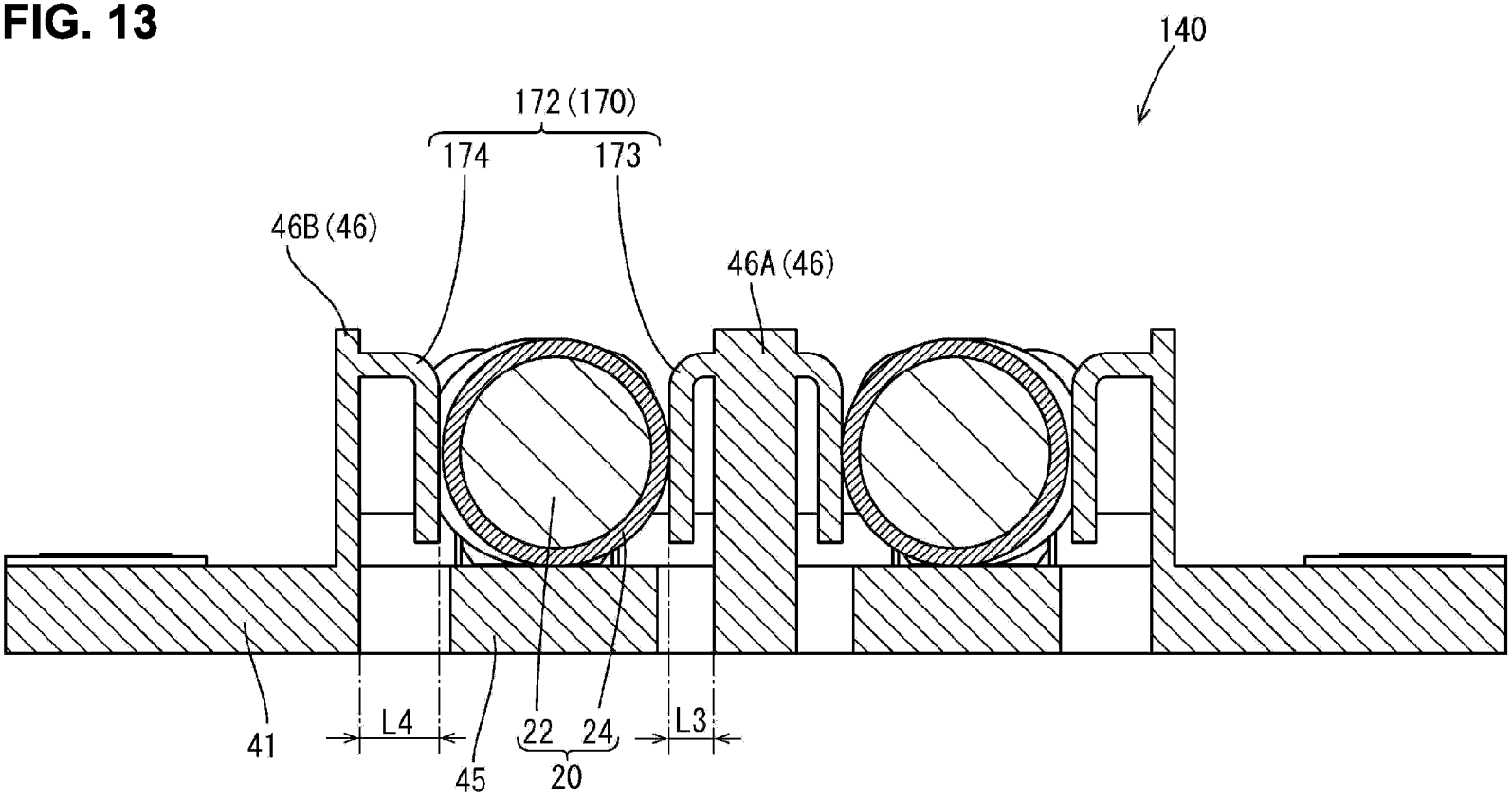
FIG. 13 is a cross-sectional view taken along the line D-D in FIG. 12.
Figure 14:
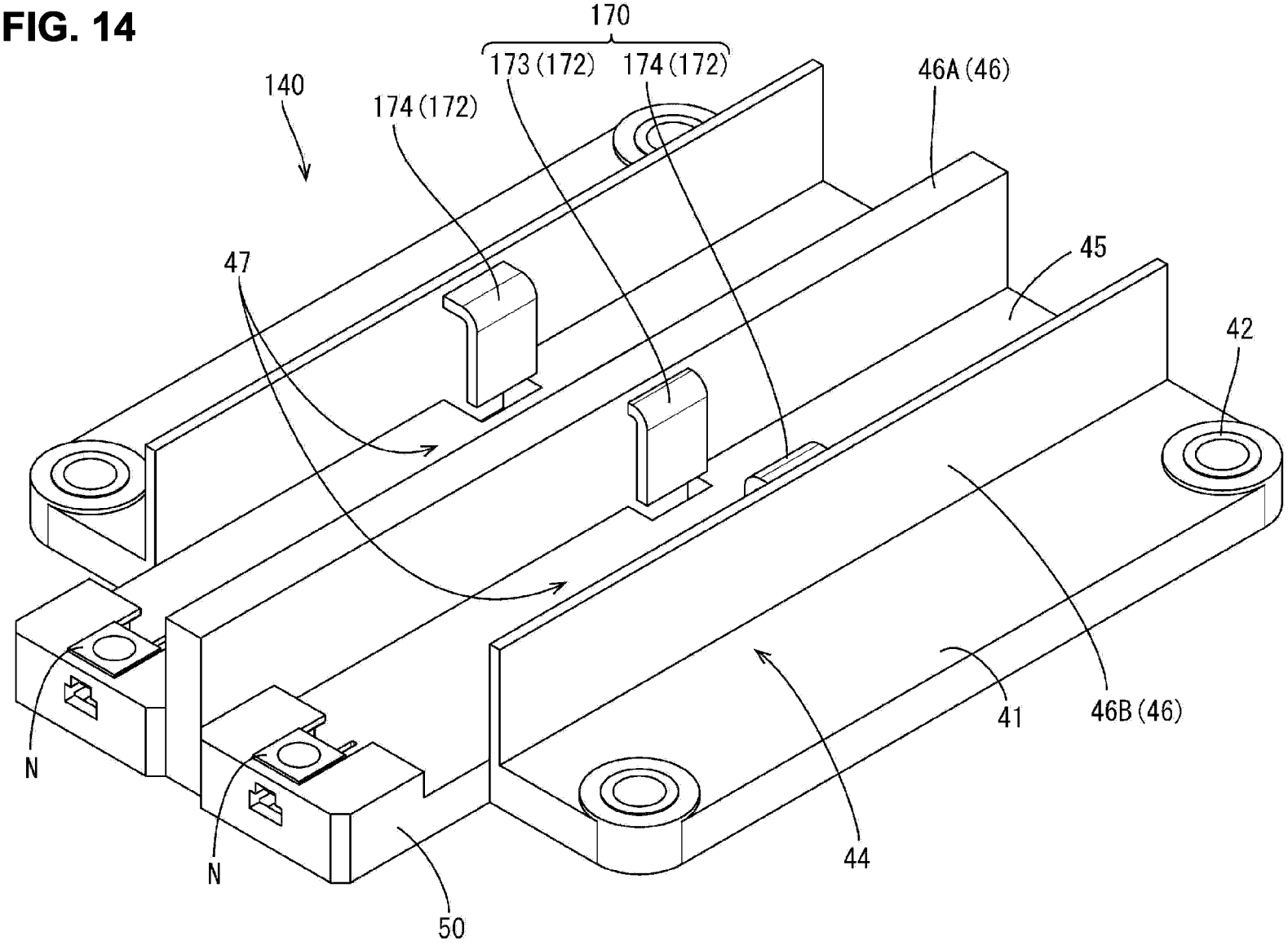
FIG. 14 is a perspective view of a terminal block according to Embodiment 2.
Figure 15:
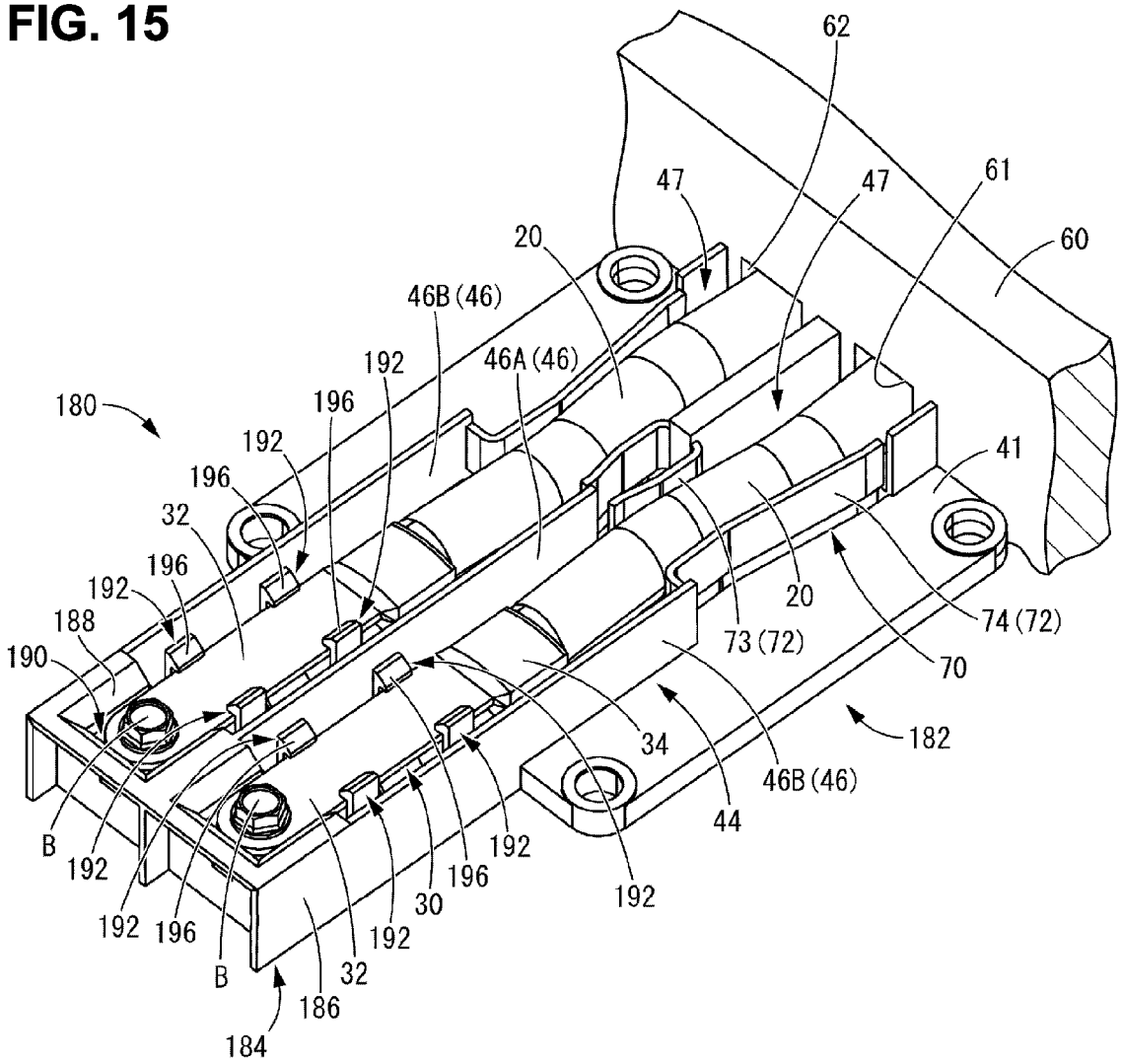
FIG. 15 is a perspective view of a wire routing unit according to Embodiment 3.

Of the pair of elastic portions 172, the elastic portion 172 provided on the outer side wall portion 46B is configured as a large elastic portion 174 whose amount of protrusion L4 to the inside of the wire installation portion 44 is set to be larger than an amount of protrusion L3 of the elastic portion 172 provided on the central side wall portion 46A, as shown in FIG. 13. The elastic portion 72 provided on the central side wall portion 46A is configured as a small elastic portion 173.

The large elastic portion 174 and the small elastic portion 173 are disposed side by side in the left-right direction, and come into contact with the same region, in the front-rear direction, of the covered wire 20 disposed between the outer side wall portion 46B and the central side wall portion 46A. The distance between the large elastic portion 174 and the small elastic portion 173 is set to be substantially the same as the outer diameter dimension of the covered wire 20.

Therefore, the covered wire 20 disposed between the outer side wall portion 46B and the central side wall portion 46A is bent toward the central side wall portion 46A side by the large elastic portion 174 protruding further toward the covered wire side than the small elastic portion 173. Accordingly, the covered wire 20 is disposed so as to be held by the large elastic portion 174 and the small elastic portion 173 from opposite sides in the left-right direction in a state in which the covered wire 20 is bent toward the central side wall portion 46A side. In addition, by coming into contact with the small elastic portion 173, the covered wire 20 is disposed in the wire installation portion 44 in a state in which a clearance CL is provided between the central side wall portion 46A and itself.

Therefore, the length dimension in the front-rear direction of the pair of elastic portions 172 of the present embodiment can be reduced as compared with that of an elastic portion extending in a cantilevered manner in, for example, the front-rear direction, which is the axial direction of the covered wire. This can reduce the size of the stress relaxation portion 170 and hence the size of the terminal block 140, in the front-rear direction.

Embodiment 3

Next, Embodiment 3 will be described with reference to FIGS. 15 to 19.

A terminal block 182 of a wire routing unit 180 according to Embodiment 3 is formed by changing the terminal block 40 of Embodiment 1 so as to provide a contact placement portion 184 in place of the contact placement portion 50. The description of the components, function, and effect that are common to Embodiment 1 is redundant and therefore has been omitted. In addition, components that are the same as those of Embodiment 1 are denoted by the same reference numerals.

The contact placement portion 184 includes a bottom plate 185 that is smaller than the attachment plate 41 and that has a substantially square shape in a plan view, and the bottom plate 185 protrudes forward of the attachment plate 41. The side wall portions 46 of the wire installation portion 44 extend out onto the contact placement portion 184, and are connected to opposite side surfaces of the bottom plate 185. Vertical wall portions 186 to which the side wall portions 46 are connected are provided at a front end of the bottom plate 185, and a distal end part of the terminal connection portion 32 is surrounded by the vertical wall portions 186.

A guide surface 188 inclined down toward a terminal accommodating region 190, which will be described later, is provided at an upper end part of each of the vertical wall portions 186. The guide surface 188 is formed as a flat surface having a fixed inclination angle, but may be formed, for example, as a curved surface, or may have an inclination angle that changes gradually. In the present embodiment, the periphery of each terminal 30 is surrounded by the central side wall portion 46A, the outer side wall portion 46B, and the vertical wall portions 186 on the contact placement portion 184, and a terminal accommodating region 190 that extends continuously with the wire routing path 47 and accommodates the terminal 30 is provided on the contact placement portion 184.

Note that in Embodiment 3, the flat plate-shaped terminal connection portion 32 provided on each of the terminals 30 extends longer in the front-rear direction, which is the axial direction of the covered wire 20, as compared with those in Embodiments 1 and 2 described above, and is formed in a rectangular shape elongated in the front-rear direction in a plan view.

A plurality of retaining portions 192 are provided on the contact placement portion 184. The retaining portions 192 are provided at positions spaced apart from the corresponding vertical wall portions 186 toward the wire installation portion 44 side in the front-rear direction. Each of the retaining portions 192 includes a leg portion 194 extending upward from the bottom plate 185 of the contact placement portion 184, and a positioning portion 196 formed as a single piece with a distal end part of the leg portion 194.

Figure 17:
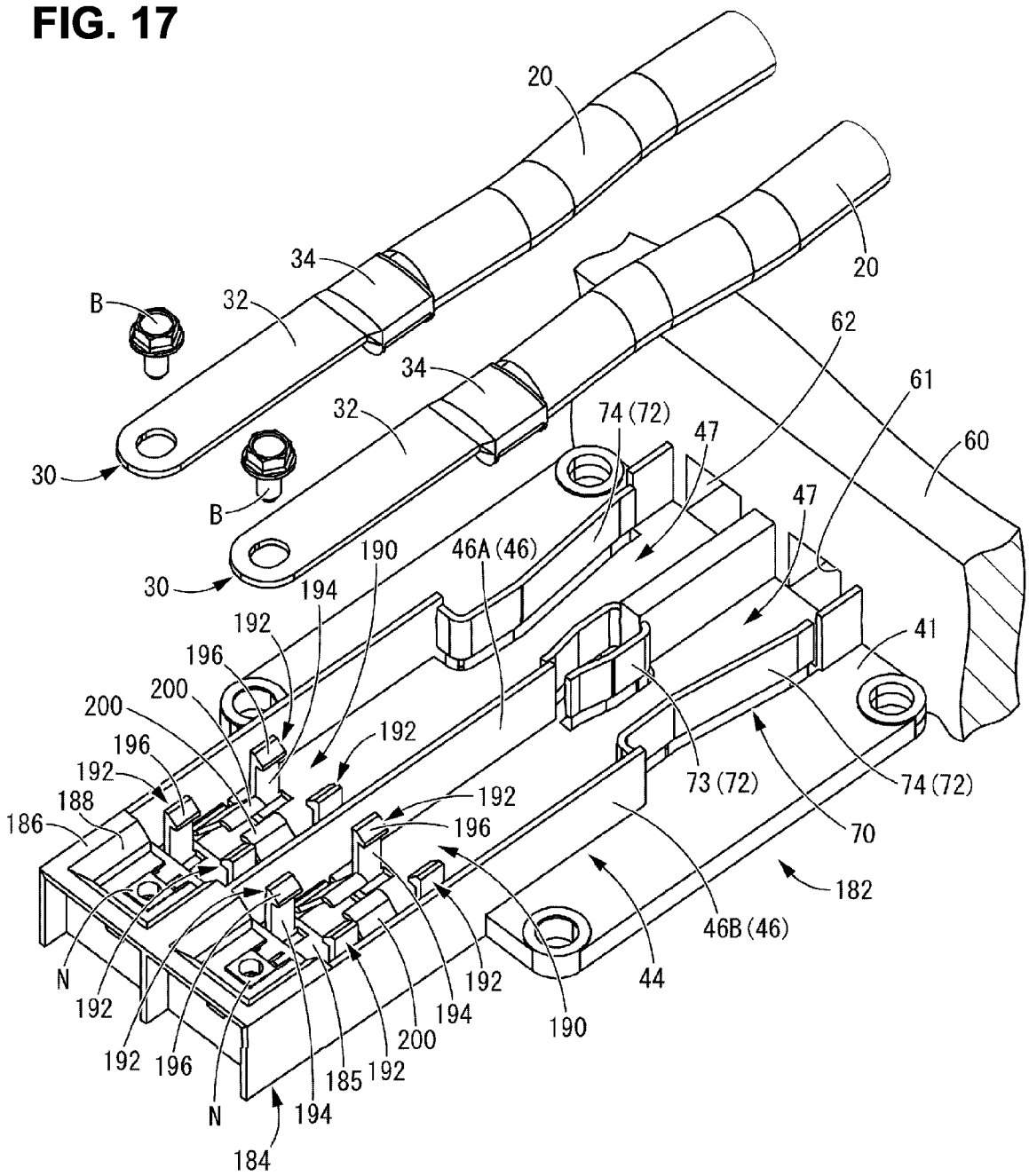
FIG. 17 is an exploded perspective view of the wire routing unit.
Figure 18:
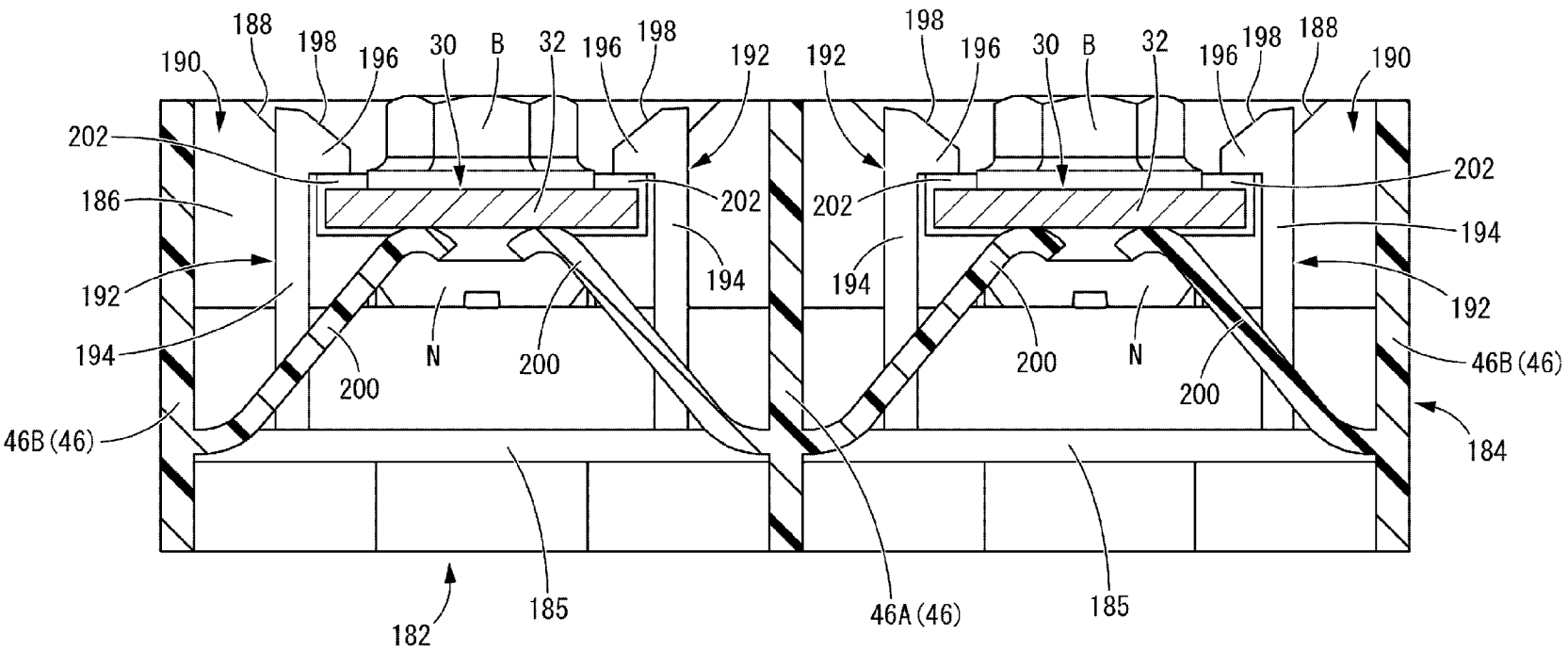
FIG. 18 is a cross-sectional view taken along the line E-E in FIG. 16.

As shown in FIGS. 17 and 18, the leg portion 194 is formed in a flat plate shape extending parallel to a side surface of the terminal connection portion 32. The leg portion 194 is made of a metal, a synthetic resin, or the like, and is formed as a single piece with the contact placement portion 184 in the present embodiment. The leg portion 194 is configured to be able to undergo elastic bending deformation in the thickness direction thereof.

As shown in FIG. 18, each positioning portion 196 is provided protruding from a protruding end part of the leg portion 194 in the thickness direction of the leg portion 194. The upper surface of the positioning portion 196 is configured as a pressing guide surface 198 formed by an inclined surface that is inclined down toward the protruding end. When a downward force is exerted on the pressing guide surface 198, the leg portion 194 undergoes bending deformation due to a component force, whereby the positioning portion 196 moves outward in the width direction.

A pair of retaining portions 192 having such a shape are provided facing each other on opposite sides in the width direction of the terminal connection portion 32 that is inserted between the side wall portions 46A and 46B. In the present embodiment, a pair of retaining portions 192 disposed opposed to each other on opposite sides in the width direction of the terminal connection portion 32 are provided at two locations at a predetermined distance in the longitudinal direction of the terminal connection portion 32, which is the front-rear direction. Note that the positioning portions 196 of the pair of retaining portions 192 protrude inward in the opposing direction of the retaining portions 192.

Elastic pressing portions 200 are provided between the pair of retaining portions 192 provided on the front side in the longitudinal direction of the terminal connection portion 32 and between the pair of retaining portions 192 provided on the rear side thereof. Each of the elastic pressing portions 200 is formed in a plate shape, and is configured to be capable of undergoing elastic bending deformation in the thickness direction thereof. As shown in FIG. 18, the elastic pressing portions 200 are each formed as a single piece with the corresponding side wall portion 46, resulting in a reduction in the number of components. The elastic pressing portions 200 extend respectively from the central side wall portion 46A and the outer side wall portions 46B and 46B toward the inner side of the terminal accommodating region 190 in the left-right direction. A distal end part of each of the elastic pressing portions 200 is located on the inner side in the left-right direction than the positioning portion 196 of the corresponding retaining portion 192. The elastic pressing portion 200 is gradually inclined up toward the distal end thereof. The elastic pressing portion 200 has a curved cross section such that a distal end part thereof is upwardly convex. The upper surface of the distal end part of the elastic pressing portion 200 is located below the lower surface of the positioning portion 196 of the corresponding retaining portion 192. Note that the bottom plate 185 of the contact placement portion 184 has manufacturing punch-out holes formed in parts thereof located below the elastic pressing portions 200.

Figure 16:
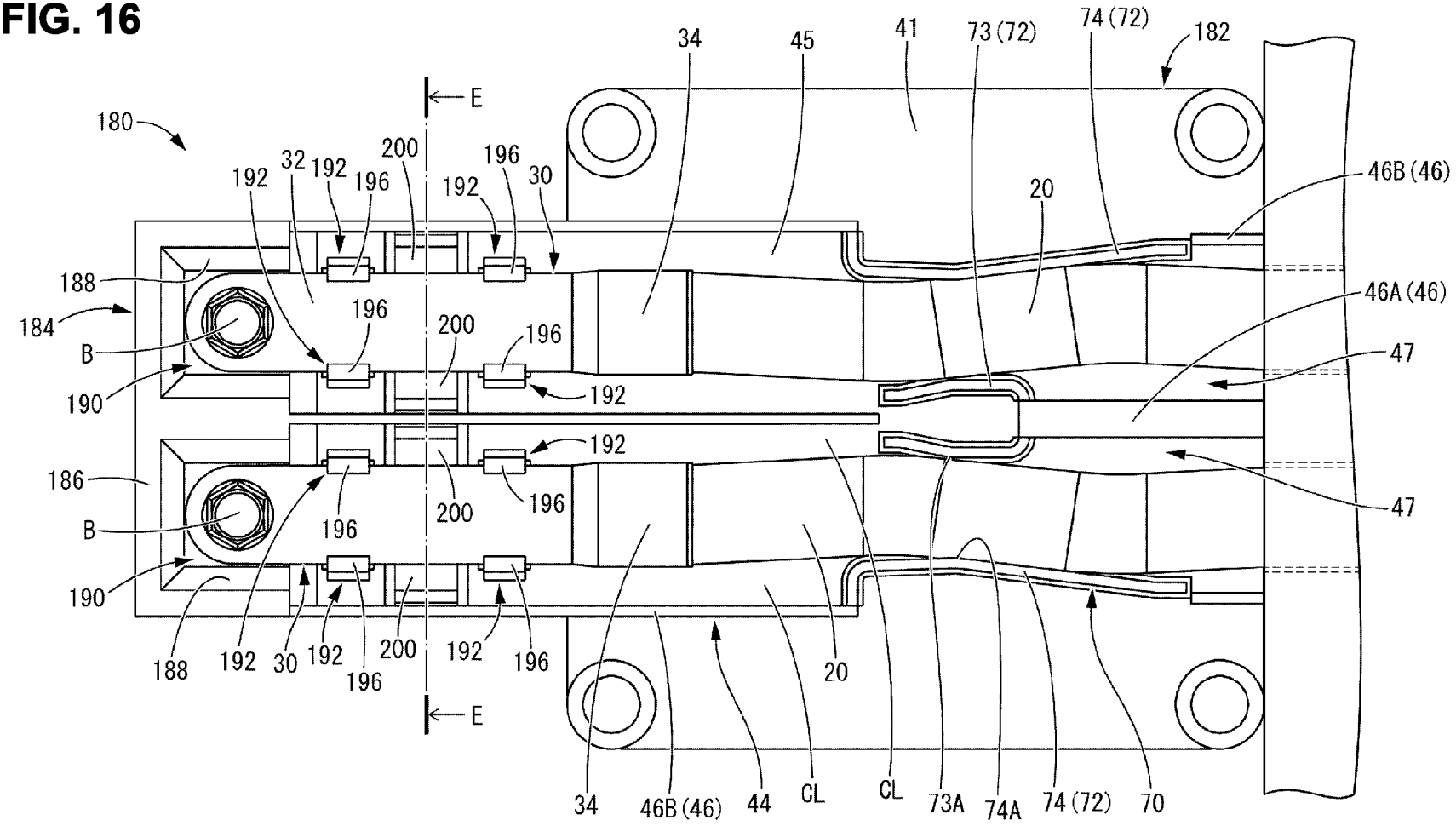
FIG. 16 is a plan view of the wire routing unit.

As shown in FIG. 16, each of the elastic pressing portions 200 is provided between the retaining portions 192 provided forward and rearward in the longitudinal direction of the terminal connection portion 32, at substantially the center therebetween. That is, in the present embodiment, the respective pairs of retaining portions 192 are provided at positions spaced by the same distance on both the front and rear sides of the elastic pressing portions 200.

In a state in which the covered wires 20 and the terminals 30 are arranged in the wire routing paths 47 and 47 and the terminal accommodating regions 190 of the terminal block 140, each terminal connection portion 32 is inserted between opposed surfaces of the leg portions 194 of each pair of retaining portions 192 provided in the terminal accommodating region 190. The opposed distance between the leg portions 194 located on opposite sides in the width direction of the terminal connection portion 32 is set to be larger than the width dimension of the terminal connection portion 32. The distance between the positioning portions 196 provided at each pair of retaining portions 192 is set to be smaller than the width dimension of the terminal connection portion 32. Accordingly, the positioning portions 196 are provided at positions overlapping the upper surface of the terminal connection portion 32 at opposite side edges of the terminal connection portion 32, and upward removal of the terminal connection portion 32 from the terminal accommodating region 190 can be prevented by the positioning portions 196.

By being inserted between the opposed surfaces of each pair of retaining portions 192 from the upper side, the terminal connection portion 32 can easily move over the positioning portions 196 and be disposed between the pair of leg portions 194. That is, lower corners of opposite side parts of the terminal connection portion 32 are pressed downward onto the pressing guide surfaces 198 of the positioning portion 196 from above. Accordingly, a component force directed outward in the width direction of the terminal connection portion 32 is exerted on the positioning portions 196, thus causing the leg portions 194 to be elastically bent, and the positioning portions 196 to move outward in the width direction. Then, through the space between the positioning portions 196 that are spread out by the bending deformation of the leg portions 194, the terminal connection portion 32 is inserted until it abuts against the elastic pressing portions 200. When the terminal connection portion 32 has been inserted to a position below the positioning portions 196, the bending deformation of the leg portions 194 is released, whereby the positioning portions 196 approach each other in the width direction so as to be disposed above opposite side edges of the terminal connection portion 32.

By being inserted into the terminal accommodating region 190 while coming into contact with the pressing guide surfaces 198 of the positioning portions 196, the terminal connection portion 32 is accommodated into the terminal accommodating region 190 while being guided to a predetermined position in the width direction. Accordingly, through a simple operation of inserting the terminal connection portion 32 between the positioning portion 196, the terminal connection portion 32 is positioned at a proper position in the terminal accommodating region 190 in the width direction. Therefore, the terminal connection portion 32 can be easily disposed at a proper position in the terminal accommodating region 190.

A guide surface 188 is provided on each of the vertical wall portions 186 constituting part of the wall of the terminal accommodating region 190 in the contact placement portion 184. Accordingly, when the terminal connection portion 32 is disposed in the terminal accommodating region 190 and attached to the contact placement portions 184, the terminal connection portion 32 is also guided to a proper position of the terminal accommodating region 190 by the distal end side of the terminal connection portion 32 moving downward while coming into contact with the guide surfaces 188. In particular, in the case where the terminal connection portion 32 is inserted from the distal end side (the lower side in FIG. 16) into the terminal accommodating region 190, the distal end side of the terminal connection portion 32 can be easily inserted into the terminal accommodating region 190.

Figure 19:
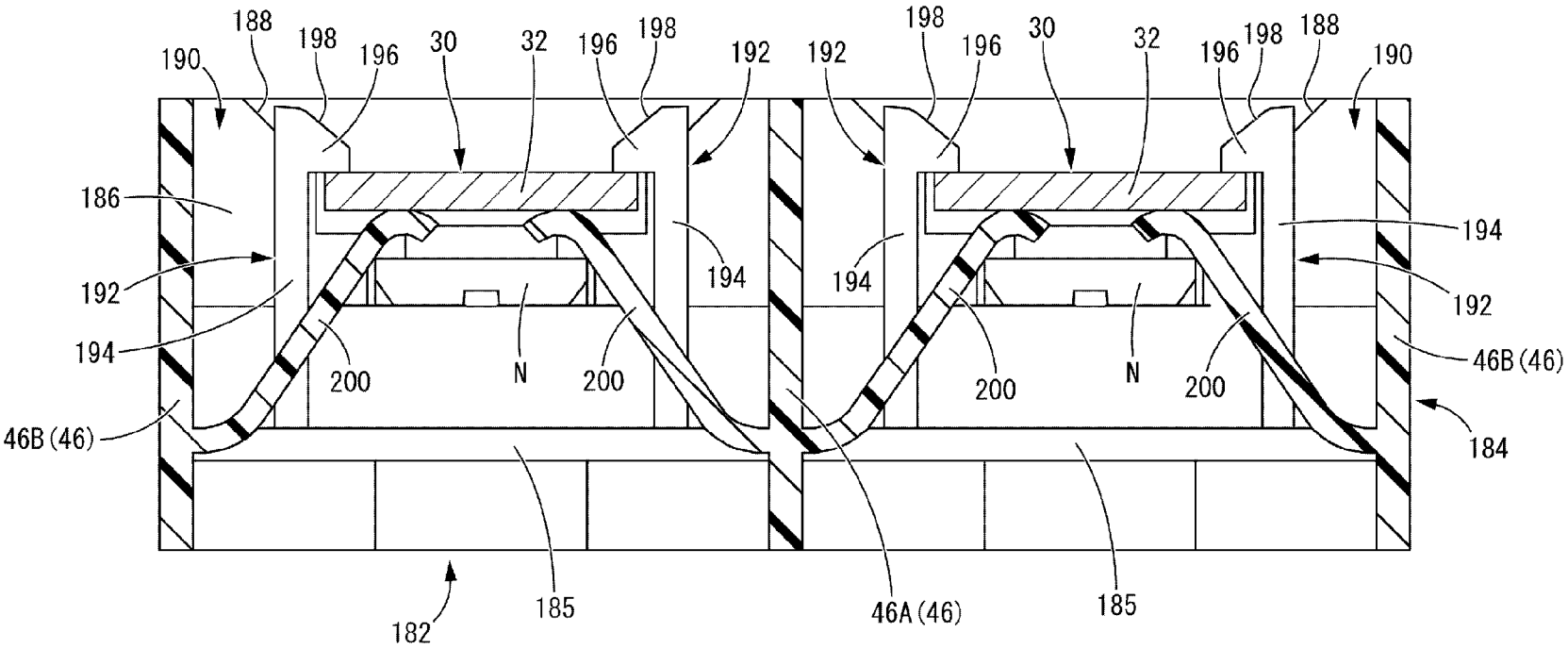
FIG. 19 is a cross-sectional view showing a set state before terminals are fastened with bolts.

As shown in FIG. 19, the upper surface, which is the front surface, of the terminal connection portion 32 inserted between each pair of retaining portions 192 is overlapped with the positioning portions 196 at opposite side edges in the width direction, and the lower surface, which is the back surface, thereof abuts against the upper surfaces of the elastic pressing portions 200. The terminal connection portion 32 is urged to the upper side, which is the positioning portion 196 side, by the elasticity of the elastic pressing portions 200, and opposite side edges of the terminal connection portion 32 abut against the positioning portions 196. The terminal connection portion 32 is inserted between each pair of retaining portions 192, and, in a set state in which the terminal connection portion 32 is not fixed through fastening of a fastening bolt B and a nut N, which will be described later, the terminal connection portion 32 is sandwiched between the positioning portions 196 and the elastic pressing portions 200.

Accordingly, in a set state before the terminal connection portion 32 is fixed as a result of the fastening bolt B being screwed to the nut N, the terminal connection portion 32 is sandwiched and held between the positioning portions 196 abutting against opposite side edges of the upper surface thereof and the elastic pressing portions 200 pressed onto the lower surface thereof. In the present embodiment, there is a possibility that torsional force is applied to the terminal connection portion 32 due to the covered wire 20 being bent and held by the stress relaxation portion 70. In addition, torsional force may be applied due to the bendability of the covered wire 20. Even in such a case, the terminal connection portion 32 is sandwiched and held between the positioning portions 196 abutting against opposite side edges of the upper surface thereof and the elastic pressing portion 200 pressed onto the lower surface thereof. Accordingly, displacement in a torsion direction of the terminal connection portion 32 is prevented, and the terminal connection portion 32 is positioned and held in a normal orientation in the terminal accommodating region 190. The normal orientation of the terminal connection portion 32 refers to an orientation in which the upper surface and the lower surface of the terminal connection portion 32 extend orthogonal to the up-down direction, which is the fastening direction of the fastening bolt B and the nut N. Therefore, the terminal connection portion 32 is prevented from being inclined in the fastening direction of the fastening bolt B and the nut N, and the operation of fastening the fastening bolt B to the nut N is facilitated, thus making it possible to stably attach the terminal connection portion 32 to the contact placement portion 50. During fastening of the terminal connection portion 32 using the fastening bolt B and the nut N, the stress acting on the fastening bolt B due to the torsional displacement of the terminal connection portion 32 is reduced.

In particular, the elastic pressing portions 200 are also respectively provided on opposite sides of the terminal connection portion 32 in the width direction, and are pressed onto the lower surface of the terminal connection portion 32 at two locations in the width direction. Accordingly, displacement in a torsion direction of the terminal connection portion 32 can be more effectively prevented.

A pair of retaining portions 192 are provided at two locations on both the front and rear sides relative to the elastic pressing portions 200. When the terminal connection portion 32 is displaced in a torsion direction, displacement in the torsion direction of the terminal connection portion 32 is restricted by the positioning portions 196 respectively at two locations spaced in the front-rear direction from the part where the lower surface of the terminal connection portion 32 is supported by the elastic pressing portions 200. This makes it possible to prevent the terminal connection portion 32 from being displaced in a twisting direction by the action of a moment due to the terminal connection portion 32 abutting against the positioning portions 196. In particular, the pairs of retaining portions 192 provided at two locations spaced apart in the front-rear direction are disposed spaced from the elastic pressing portions 200 by the same distance on opposite sides in the front-rear direction. Accordingly, the moment due to the abutment between the terminal connection portion 32 and the positioning portions 196 can be more effectively cancelled out.

In the above-described set state shown in FIG. 19, the terminal connection portion 32 is spaced above the nut N. Accordingly, an error in the relative distance in the up-down direction between the upper surface of the nut N and the lower surfaces of the positioning portions 196 is allowed, thus enabling the terminal connection portion 32 to be stably inserted between the top and bottom of the positioning portions 196 and the nut N.

As in the cases of Embodiments 1 and 2, a terminal end part of the terminal connection portion 32 that is set in the terminal accommodating region 190 is fixed to the contact placement portion 50 through fastening of the fastening bolt B to the nut N. As shown in FIG. 18, as a result of the fastening bolt B being fastened to the nut N, the terminal connection portion 32 is moved downward and overlapped with the nut N in abutment thereagainst. Accordingly, in a state in which the fastening bolt B is fastened to the nut N, the terminal connection portion 32 is spaced below the positioning portions 196, thus forming a gap 202 between the upper surface of the terminal connection portion 32 and the lower surfaces of the positioning portions 196. Although the illustration of the device-side connection portion T has been omitted in FIG. 18, the terminal connection portion 32 is connected to the device-side connection portion T in contact therewith through fastening of the fastening bolt B to the nut N, as in the cases of Embodiments 1 and 2.

Other Embodiments

Although Embodiments 1, 2, and 3 have been described in detail as specific examples of the present disclosure, the present disclosure is not limited by the specific descriptions thereof. Modifications, improvements, and the like in a range in which the object of the present disclosure can be achieved are encompassed by the present disclosure. For example, the following embodiments are also included in the technical scope of the present disclosure.

(1) In the above embodiments, the stress relaxation portion 70 or 170 is formed by the plurality of elastic portions 72 or 172. However, the present disclosure is not limited thereto, and the stress relaxation portions 70 and 170 may be formed by installing a separate rubber material between the wire installation portion and the covered wire, or may be formed by disposing a metal clip or the like between the wire installation portion and the covered wire.

(2) In the above embodiments, the covered wire 20 is bent by the pair of elastic portions 72 or 172. However, the present disclosure is not limited thereto, and it is possible to adopt a configuration in which three or more elastic portions are provided as long as a space can be secured in the front-rear direction.

(3) In the above embodiments, the elastic portions 72 or 172 are formed on the pair of side wall portions 46 extending upward from the bottom wall portion 45. However, the present disclosure is not limited thereto, and the elastic portions may be formed on the bottom wall portion.

(4) In the above embodiments, the pair of elastic portions 72 or 172 are disposed in the same region in the front-rear direction. However, the present disclosure is not limited thereto, and it is possible to adopt a configuration in which the pair of elastic portions are shifted in the front-rear direction as long as a space can be secured in the front-rear direction.

(5) In the above embodiments, the pair of elastic portions 72 or 172 are configured in a cantilevered manner. However, the present disclosure is not limited thereto, and the elastic portions may be configured to be supported at both ends.

(6) Although Embodiment 3 described above illustrates a structure in which four retaining portions 192 are provided in each of the terminal accommodating regions 190, the number of retaining portions 192 is not limited. The number of retaining portions 192 provided on opposite sides in the width direction of the terminal connection portion 32 may be different between the left side and the right side. Similarly, the number of elastic pressing portions 200 is not limited, and may be different between the left and right elastic pressing portions 200.

(7) In Embodiment 3 described above, the positioning portions 196 may be overlapped with the surface of the terminal connection portion 32 at least at opposite side ends in the left-right direction, and may not necessarily be overlapped only at opposite side ends in the left-right direction. The positioning portions 196 are not limited to structures that are separately provided on opposite sides in the left-right direction of the terminal connection portion 32. For example, it is possible to adopt a positioning portion extending across the terminal connection portion 32 in the width direction, and the positioning portion may be continuously overlapped with the surface of the terminal connection portion 32 over the entire length in the width direction. In this case, for example, the positioning portion may be configured to be removable from the contact placement portion 50, and the positioning portion may be attached to the contact placement portion 50 after setting the terminal connection portion 32 to the contact placement portion 50. Alternatively, for example, the terminal connection portion 32 may be inserted and set between the positioning portions and the elastic pressing portions 200 in the front-rear direction.

(8) In Embodiment 3 described above, the elastic pressing portions 200 are not necessarily limited to portions extending from the side wall portion 46, and may be each formed as a single piece with the bottom wall portion 45 of the wire installation portion 44, for example. The elastic pressing portions may also be each formed, for example, by a separate coil spring or the like supported by the bottom wall portion 45 of the wire installation portion 44.

(9) In Embodiment 3 described above, the retaining portions 192 are provided on both the front and rear sides of the elastic pressing portions 200; however, the retaining portions 192 may be provided only one of the front and rear sides relative to the elastic pressing portion 200. It is also possible that the elastic pressing portions 200 are provided on both the front and rear sides of the retaining portion 192. In that case as well, the tilting in a twisting direction of the terminal connection portion 32 can be prevented.

LIST OF REFERENCE NUMERALS

10, 110, 180 Wire routing unit
20 Covered wire (example of "wire")
22 Core wire
24 Insulating covering
30 Terminal
32 Terminal connection portion (example of "connection portion")
34 Wire connection portion
35 Barrel
40, 140, 182 Terminal block
41 Attachment plate
42 Collar
44 Wire installation portion
45 Bottom wall portion
46 Side wall portion
46A Central side wall portion
46B Outer side wall portion
47 Wire routing path
50, 184 Contact placement portion
60 Enclosure portion
61 Wire accommodating portion
62 Wall portion
70, 170 Stress relaxation portion
72, 172 Elastic portion
73, 173 Small elastic portion
73A Part coming into contact with covered wire
74, 174 Large elastic portion
74A Part coming into contact with covered wire
185 Bottom plate

186 Vertical wall portion
188 Guide surface
190 Terminal accommodating region
192 Retaining portion
194 Leg portion
196 Positioning portion
198 Pressing guide surface
200 Elastic pressing portion
202 Gap
B Fastening bolt
CL Clearance
L1 Amount of protrusion
L2 Amount of protrusion
L3 Amount of protrusion
L4 Amount of protrusion
N Nut
T Device-side connection portion (example of "counterpart connection portion")

The invention claimed is:

1. A terminal block that electrically connects a connection portion provided at a terminal end of a wire and a counterpart connection portion to each other, the terminal block comprising:

a contact placement portion on which the connection portion and the counterpart connection portion are disposed in contact with each other;

a wire installation portion that is provided continuously with the contact placement portion and on which the wire is disposed; and a stress relaxation portion that is disposed between the wire installation portion and the wire so as to be elastically displaceable, and that bends and holds the wire in a state in which a clearance is provided between the wire and the wire installation portion, wherein the wire installation portion includes first and second side wall portions disposed on opposite sides of the wire, and extending along the wire, the stress relaxation portion includes first and second elastic portions separate from each other, each of the first and second elastic portions having a plate shape, and the first and second elastic portions are respectively provided on the first and second side wall portions and are bent to respectively protrude from the first and second side wall portions toward the wire, such that the first and second elastic portions are elastically displaceable in a direction intersecting an axial direction of the wire and contact and hold the wire in a bent state so as to provide a clearance between the wire and both of the first and second side wall portions.

2. A wire routing unit comprising:

the terminal block according to claim 1; and an enclosure portion that accommodates the wire pulled out from the wire installation portion of the terminal block to a side opposite to the contact placement portion, wherein the wire accommodated in the enclosure portion and a wall portion of the enclosure portion are disposed in proximity to each other.

3. The terminal block according to claim 1, wherein a length of the first elastic portion in the axial direction of the wire is longer than a length of the second elastic portion in the axial direction of the wire.

4. The terminal block according to claim 1, the first and second elastic portions are provided in the same region in the axial direction of the wire, and an amount of protrusion of the first elastic portion from the first side wall portion toward the wire is larger than an amount of protrusion of the second elastic portion from the second side wall portion toward the wire.

5. The terminal block according to claim 4, wherein the wire installation portion includes a bottom wall portion on which the wire is mounted, and the first and second side wall portions extending from the bottom wall portion, and the first and second elastic portions protrude in a cantilevered manner toward the wire from the first and second side wall portions, respectively.

6. The terminal block according to claim 5, wherein the first and second elastic portions extend in a cantilevered manner in a direction intersecting the bottom wall portion.

7. A terminal block, that electrically connects a connection portion provided at a terminal end of a wire and a counterpart connection portion to each other, the terminal block comprising:

a contact placement portion on which the connection portion and the counterpart connection portion are disposed in contact with each other;

a wire installation portion that is provided continuously with the contact placement portion and on which the wire is disposed; and a stress relaxation portion that is disposed between the wire installation portion and the wire so as to be elastically displaceable, and that bends and holds the wire in a state in which a clearance is provided between the wire and the wire installation portion, wherein the connection portion has a flat plate shape, and the terminal block comprises: positioning portions that position the connection portion in a normal orientation by abutting against at least surfaces of opposite side edges of the connection portion; and an elastic pressing portion that urges the connection portion by coming into contact with a back surface of the connection portion.

8. The terminal block according to claim 7, wherein the wire installation portion includes a plurality of side wall portions disposed along the wire, and the stress relaxation portion includes a plurality of elastic portions that are provided on the plurality of side wall portions so as to be elastically displaceable in a direction intersecting an axial direction of the wire, and that hold the wire in a bent state so as to provide a clearance between the wire and the side wall portions.

9. The terminal block according to claim 7, wherein leg portions are provided that are disposed on opposite sides in a width direction of the connection portion and are elastically deformable outwardly in the width direction of the connection portion, and the positioning portions protrude from the leg portions.

10. The terminal block according to claim 7, wherein the elastic pressing portion is formed as a single piece with the contact placement portion.

11. The terminal block according to claim 7, wherein the positioning portions are provided on opposite sides in a length direction of the connection portion relative to the elastic pressing portion.

* * * * *